US005317873A

United States Patent [19]

Okuda et al.

[11] Patent Number: 5,317,873

[45] Date of Patent: Jun. 7, 1994

[54] HIGH EFFICIENCY REDUCED-NOISE SWASH-PLATE-TYPE HYDRAULIC DEVICE

[75] Inventors: Akihito Okuda; Yoshihiro Kanamaru; Toshiaki Tane, all of Utsunomiya; Michio Suzuki, Tachikawa; Hirohisa Ogawa, Wako, all of Japan

[73] Assignee: Honda Giken Kogyo Kabushiki Kaisha, Tokyo, Japan

[21] Appl. No.: 836,622

[22] Filed: Feb. 13, 1992

[30] Foreign Application Priority Data

Feb. 14, 1991 [JP] Japan ..... 3-042547
Feb. 14, 1991 [JP] Japan ..... 3-042548

[51] Int. Cl.[5] ..... F16D 39/00; F15B 3/00

[52] U.S. Cl. ..... 60/487; 91/505; 92/12.2; 92/57; 92/71; 74/60; 417/269

[58] Field of Search ..... 60/487, 488, 489, 491, 60/492; 91/504, 505; 92/12.2, 57, 71; 74/60; 417/269, 218

[56] References Cited

U.S. PATENT DOCUMENTS

| | | | |
|---|---|---|---|
| 2,299,235 | 10/1942 | Snader et al. | 91/488 |
| 2,853,025 | 9/1958 | Meter | 91/505 |
| 3,036,434 | 5/1962 | Mark | 60/456 |
| 3,604,314 | 9/1971 | Steiner | 91/505 |
| 3,890,883 | 6/1975 | Rometsch et al. | 91/499 |
| 4,637,293 | 1/1987 | Yamaguchi et al. | 91/507 |
| 4,891,944 | 1/1990 | Okuda et al. | 60/489 |
| 5,033,358 | 6/1991 | Molly | 91/504 |

FOREIGN PATENT DOCUMENTS

| | | |
|---|---|---|
| 900530 | 12/1953 | Fed. Rep. of Germany . |
| 2082604 | 12/1971 | France . |
| 61-118566 | 5/1986 | Japan . |
| 63-96372 | 6/1988 | Japan . |
| 2-129461 | 5/1990 | Japan . |

*Primary Examiner*—Edward K. Look
*Assistant Examiner*—Hoang Nguyen
*Attorney, Agent, or Firm*—Lyon & Lyon

[57] ABSTRACT

A swash-plate plunger-type hydraulic device has a cylinder block with a plurality of plungers slidably fitted in cylinder bores, a swash plate confronting one end of the cylinder block, and a distribution valve plate slidably held against the other end of the cylinder block. The cylinder block has an even number of circularly arrayed connecting ports communicating with the cylinder bores and opening at the other end thereof. The distribution valve plate has inlet and outlet ports. The cylinder block is rotatable through an angular displacement $\theta 1$ in which the hydraulic pressure in one connecting port between the inlet and outlet ports increases from a lower pressure to a higher pressure, through an angular displacement $\theta 2$ in which the hydraulic pressure in one connecting port between the inlet and output ports decreases from the higher pressure to the lower pressure, and through an angular displacement $\theta 3$ from a position where the hydraulic pressure starts to increase to a position where the hydraulic pressure starts to decrease. The inlet and outlet ports are defined such that the angular displacements $\theta 1$, $\theta 2$, $\theta 3$ are expressed by:

$$\theta 1 = \theta 2 \text{ and } \theta 3 = 180^\circ.$$

10 Claims, 16 Drawing Sheets

HIGH EFFICIENCY REDUCED-NOISE SWASH-PLATE-TYPE HYDRAULIC DEVICE

BACKGROUND OF THE INVENTION

1. FIELD OF THE INVENTION

The present invention relates to a swash-plate plunger-type hydraulic device such as a swash-plate plunger-type hydraulic pump, a swash-plate plunger-type hydraulic motor, or the like.

2. DESCRIPTION OF THE PRIOR ART:

One known swash-plate plunger-type hydraulic device for use as a pump or a motor is disclosed in Japanese Laid-Open Patent Publication No. 61-118566, for example. Such a swash-plate plunger-type hydraulic device generally has an odd number of plungers that are movable in discharge and suction strokes at different times, or out of phase with each other, for reducing flow rate and torque fluctuations.

Swash-plate plunger-type hydraulic pump and motor may be combined into a hydraulically operated continuously variable transmission. In such a hydraulically operated continuously variable transmission, each of the pump and the motor has an odd number of plungers that are also actuatable in discharge and suction strokes out of phase.

When a plunger shifts in a cylinder from the discharge stroke (compressing stroke) to the suction stroke (expanding stroke), it develops an abrupt change in the hydraulic pressure in the cylinder. The change in the hydraulic pressure is transmitted as vibrating forces to the plunger, the swash plate, and the casing of the hydraulic device. It is known that the transmitted vibrating forces are responsible for the generation of noise from the hydraulic device and the hydraulically operated continuously variable transmission employing the same.

Various attempts have heretofore been proposed to lessen the above change in the hydraulic pressure. For example, pre-compressing and pre-expanding intervals are provided between the discharge and suction strokes, and a restriction passage such as a V-shaped groove, a recess, a regulator valve, or the like is defined to reduce the pressure variation. For details, see Japanese Laid-Open Utility Model Publication No. 63-96372 and Japanese Laid-Open Patent Publication No. 2-129461, for example.

However, the conventional proposals are only effective to attenuate the change in the hydraulic pressure in the cylinder which houses each plunger. The total value of thrust loads imposed on all the plungers is still subject to fluctuations that are applied as vibrating forces. Therefore, it is difficult to lower the noise level to a sufficiently low level.

The fluctuations of the total thrust load will be described below with reference to FIG. 24 of the accompanying drawings. FIG. 24 shows thrust loads F1 through F9 that are applied to respective nine plungers of a swash-plate plunger-type hydraulic pump, and a total thrust load Ft which is the sum of the thrust loads F1 through F9, when the cylinder block rotates. The graph of FIG. 27 has a horizontal axis which is indicative of time, but which may be indicative of the angular displacement of the cylinder block since the angular displacement varies with time. Study of FIG. 27 indicates that the thrust load exerted to each plunger smoothly varies in load increasing and decreasing zones, and the total thrust load Ft fluctuates as shown.

In the case where a swash-plate plunger-type hydraulic pump or motor is of the variable displacement type and has a support shaft by which the swash plate is tiltably supported, or a swash-plate plunger-type hydraulic pump or motor is of the fixed displacement type and has a support shaft similar to the support shaft by which the swash plate is tiltably supported, even if changes in the hydraulic pressure in the cylinder housing each plunger are lessened, variations in the moment about the support shaft, which are also responsible for vibrating forces, cannot sufficiently be suppressed. Therefore, it is difficult to sufficiently lower the noise produced by such a pump or motor.

In such a swash-plate plunger-type hydraulic pump or motor, if it has an even number of plungers, then the pulsating ratio of a discharged flow from the hydraulic device is calculated as follows:

FIG. 25 of the accompanying drawings shows a hydraulic pump model in which a cylinder block 101 has an odd number of angularly spaced cylinder bores 111 defined therein and a number of plungers 112 slidably disposed respectively in the cylinder bores 111, with a swash plate 106 held against the tip ends of the plungers 112. The total stroke L of a plunger 112 is given by:

$$L=2R\tan\alpha \tag{a}$$

where R is the radius of a circle passing through the centers of the cylinder bores 111, and $\alpha$ is the angle at which the swash plate 106 is tilted. The displacement D of the plungers 112 is expressed as follows:

$$D=ZAL=2ZAR\tan\alpha \tag{b}$$

where A is the pressure-bearing surface area of the plungers 112, and Z is the number of the plungers 112.

While a plunger 112 is being angularly moved an angle $\theta$ from the bottom dead center (BDC), the plunger 112 axially moves a distance x:

$$x=L/2-R\cos\theta\tan\alpha=L/2\times(1-\cos\theta) \tag{c}$$

Therefore, the speed v at which the plunger 112 axially moves is given as follows:

$$v=dx/dt=(L\omega/2)\times\sin\theta \tag{d}$$

where $\omega$ is the angular velocity of the cylinder block 101.

It is assumed that the number of plungers 112 that are in the discharge stroke is expressed by ZO. From the equation (d), the instantaneous discharge rate Qt of the hydraulic pump is given by:

$$Qt=\Sigma Avi=(AL\omega/2)\Sigma\sin\theta i \tag{e}$$

The equation (e) can be modified into:

$$Qt=(AL\omega/2)\times\sin(\pi Z0/Z)\times\sin\{\theta+\pi(Z0-1)/Z\}/\sin(\pi/Z) \tag{f}$$

Since the number Z of the plungers 112 is even, the equation (f) is therefore modified into:

$$Qt=(AL\omega/2)\times\cos(\theta-\pi/Z)/\sin(\pi/Z) \tag{g}$$

The instantaneous discharge rate Qt is shown in FIG. 26 of the accompanying drawings. As can be understood from FIG. 26, if the number of the plungers 112 is even, then the discharged flow pulsates Z times while the cylinder block 101 makes one revolution. The pulsating ratio Σ of the instantaneous discharge rate is expressed by:

$$\Sigma = \pi/Z \times \tan(\pi/2Z) \quad \text{(h).}$$

According to this equation, actual pulsating ratios Σ with different numbers of plungers are calculated as follows:

| Z | 6 | 8 | 10 | 12 |
|---|---|---|---|---|
| ε (%): | 14.0 | 7.81 | 4.97 | 3.45 |

The above theoretical study is based on Hydraulic Engineering written by Tsuneo Ichikawa and Akira Hibi.

The foregoing analysis of the pulsating ratio assumes that the hydraulic pressure in the cylinder bores varies according a rectangular pattern as shown in FIG. 27(A) of the accompanying drawings. In actual swash-plate plunger-type hydraulic pumps or motors, however, pre-compressing and pre-expanding zones or restriction passages are employed to cause the hydraulic pressure to vary according to a trapezoidal pattern for thereby preventing the hydraulic pressure from abruptly varying upon a plunger transition from the suction stroke to the discharge stroke and a plunger transition from the discharge stroke to the suction stroke. Consequently, actual pressure changes are indicated by a trapezoidal pattern as shown in FIG. 27(B) of the accompanying drawings. As a result, the actual pulsating ratio differs from the theoretically determined pulsating ratio.

While the trapezoidal pressure pattern is effective in preventing abrupt pressure changes to reduce vibrating forces applied to the swash plate and other components, it rather increases the pulsating ratio, giving rise to abnormal vibration (torque fluctuations), as evidenced by various experiments.

SUMMARY OF THE INVENTION

It is an object of the present invention to provide a swash-plate plunger-type hydraulic device which lessens changes (increases and reductions) in the hydraulic pressure in cylinder bores housing respective plungers, and which also minimizes any fluctuation of a total thrust load imposed on the plungers.

Another object of the present invention is to provide a swash-plate plunger-type hydraulic device which lessens changes (increases and reductions) in the hydraulic pressure in cylinder bores housing respective plungers, and which also reduces fluctuations of the moment about a support shaft by which a swash plate is supported.

Still another object of the present invention is to provide a swash-plate plunger-type hydraulic device with an even number of plungers, which lessens changes in the hydraulic pressure in cylinder bores to reduce vibrating forces applied to a swash plate and other components, and which also suppresses an increase in the pulsating ratio of a discharged flow.

To accomplish the above objects, there is provided a swash-plate plunger-type hydraulic device comprising a rotatable shaft, a cylinder block mounted on the rotatable shaft for rotation in unison therewith, the cylinder block having an even number of cylinder bores arranged in an annular array around the rotatable shaft and extending axially of the rotatable shaft, the cylinder bores opening at one axial end of the cylinder block, an even number of plungers slidably fitted in the cylinder bores, a swash plate disposed in confronting relation to said one axial end of the cylinder block, the plungers having ends slidably held against the swash plate, and a distribution valve plate slidably held against an opposite axial end of the cylinder block, the cylinder block having an odd number of circularly arranged connecting ports defined therein in communication with the cylinder bores, respectively, and opening at the opposite axial end, the distribution valve plate having an inlet port defined therein in communication with the cylinder bores housing those plungers which are in an expansion stroke, through the connecting ports upon rotation of the cylinder block, and an outlet port defined therein in communication with the cylinder bores housing those plungers which are in a compression stroke, through the connecting ports upon rotation of the cylinder block, the arrangement being such that the cylinder block is rotatable with the rotatable shaft through an angular displacement $\theta 1$ corresponding to an angular interval in which one, at a time, of the connecting ports is positioned between the inlet and outlet ports and a hydraulic pressure in said one of the connecting ports and the cylinder bore communicating therewith increases from a lower hydraulic pressure within one of the inlet and outlet ports to a higher hydraulic pressure within the other of the inlet and outlet ports, through an angular interval $\theta 2$ corresponding to an angular interval in which one, at a time, of the connecting ports is positioned between the inlet and outlet ports and a hydraulic pressure in said one of the connecting ports and the cylinder bore communicating therewith decreases from the higher hydraulic pressure within the other of the inlet and outlet ports to the lower hydraulic pressure within said one of the inlet and outlet ports, and through an angular interval $\theta 3$ corresponding to an angular interval from a position where the hydraulic pressure starts to increase to a position where the hydraulic pressure starts to decrease, the inlet and outlet ports being defined such that the angular displacements $\theta 1$, $\theta 2$, $\theta 3$ are expressed by:

$$\theta 1 = \theta 2$$

and $$\theta 3 = 180°.$$

The inlet and outlet ports may preferably be defined such that the angular displacements $\theta 1$, $\theta 2$, $\theta 3$ are expressed by:

$$\theta 1 = \theta 2 = 360°/Z \times k$$

where

Z: the number of the plungers (even number); and $k = 1, 2, 3, \ldots$ (integer).

This arrangement causes the hydraulic pressure in the cylinder bores to vary, i.e., increase and decrease, gradually, and also reduce variations in the moment applied about the support shaft by which the swash plate is supported.

Furthermore, the inlet and outlet ports may be defined such that the angular displacements $\theta 1$, $\theta 2$ are substantially equal to:

$$\alpha = 469 \times Z^{-1.0315} \text{ (degrees)}$$

where Z: the number of the plungers (even number).

This arrangement is effective to lessen changes in the hydraulic pressure in the cylinder bores to reduce vibrating forces applied to the swash plate and other components, and also to suppress an increase in the pulsating ratio of a discharged flow.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
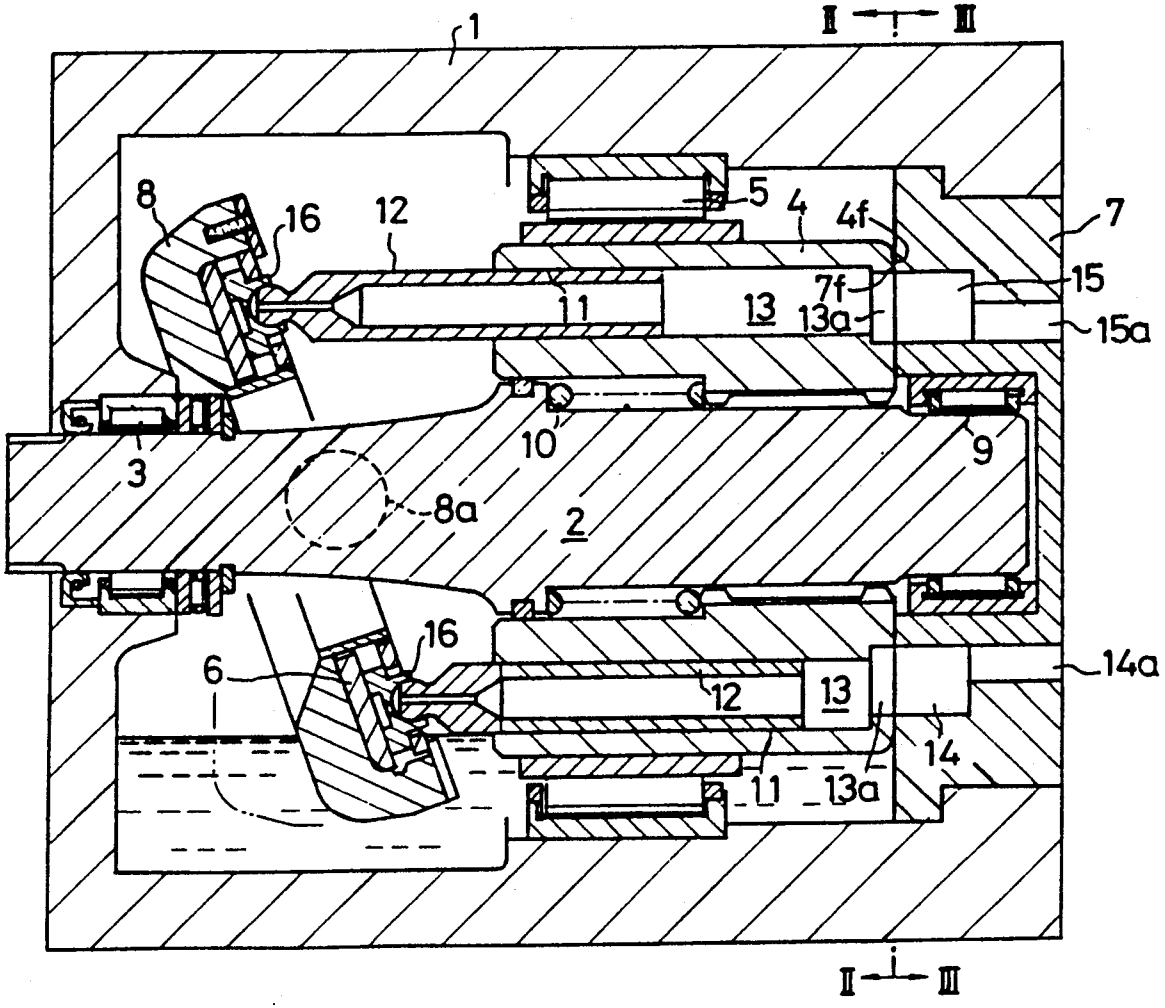
FIG. 1 is a cross-sectional view of a swash-plate plunger-type hydraulic pump according to a first embodiment of the present invention.

Like or corresponding parts are denoted by like or corresponding reference characters throughout views.

EMBODIMENT 1

FIG. 1 shows a swash-plate plunger-type hydraulic pump according to a first embodiment of the present invention. The hydraulic pump has a casing 1 in which an input shaft 2 is rotatably supported by a bearing 3. A cylinder block 4 is axially slidably splined to the input shaft 2. The cylinder block 4 is rotatably supported in the casing 1 by a bearing 5. The casing 1 houses therein a swash plate 6 positioned on one side (lefthand side as shown) of the cylinder block 4 and a distribution valve plate 7 on the other side (righthand side as shown) of the cylinder block 4.

The swash plate 6 is of an annular shape surrounding the input shaft 2, and is mounted in an annular swash plate holder 8 which is tiltably supported in the casing 1 by a trunnion (support shaft) 8*a*. The swash plate 6 together with the swash plate holder 8 is therefore tiltable about the trunnion 8*a* through a desired angle with respect to the axis about which the cylinder block 4 is rotatable.

The distribution valve plate 7 is fixed to the casing 1. An end of the input shaft 2 extending through the cylinder block 4 is supported by the distribution valve plate 7 through a bearing 9. The distribution valve plate 7 and the cylinder block 4 have respective confronting surfaces 7*f*, 4*f* that are slidably held against each other under the bias of a spring 10, which is disposed between the input shaft 2 and the cylinder block 4 for normally urging the cylinder block 4 toward the distribution valve plate 7.

Figure 2:
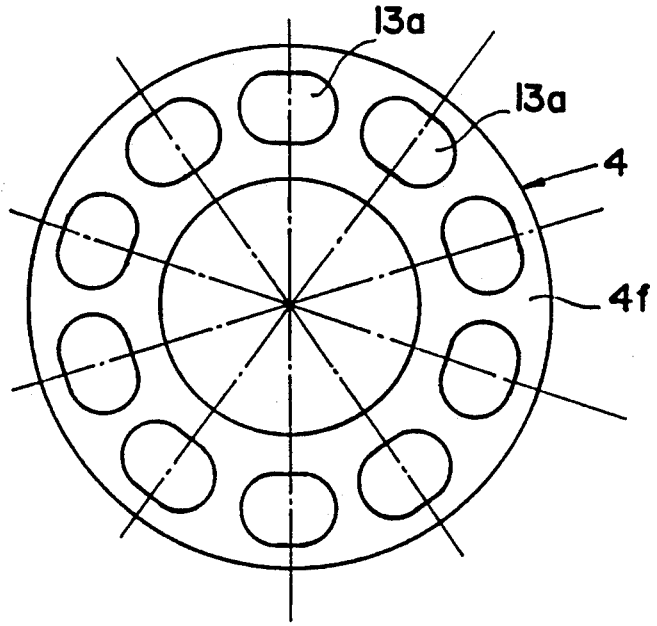
FIG. 2 is an elevational view taken along line II-II of FIG. 1.

The cylinder block 4 has ten equally angularly spaced cylinder bores 11 defined around and extending parallel to the axis of rotation thereof, with respective plungers 12 slidably fitted in the cylinder bores 11. The plungers 12 define respective hydraulic chambers 13 in the corresponding cylinder bores 11. The cylinder block 4 also has ten connecting ports 13*a* communicating with the respective hydraulic chambers 13 and opening at the surface 4*f* of the cylinder block 4, as shown in FIG. 2. The open ends of the connecting ports 13*a* are angularly spaced along a common circle.

Figure 3:
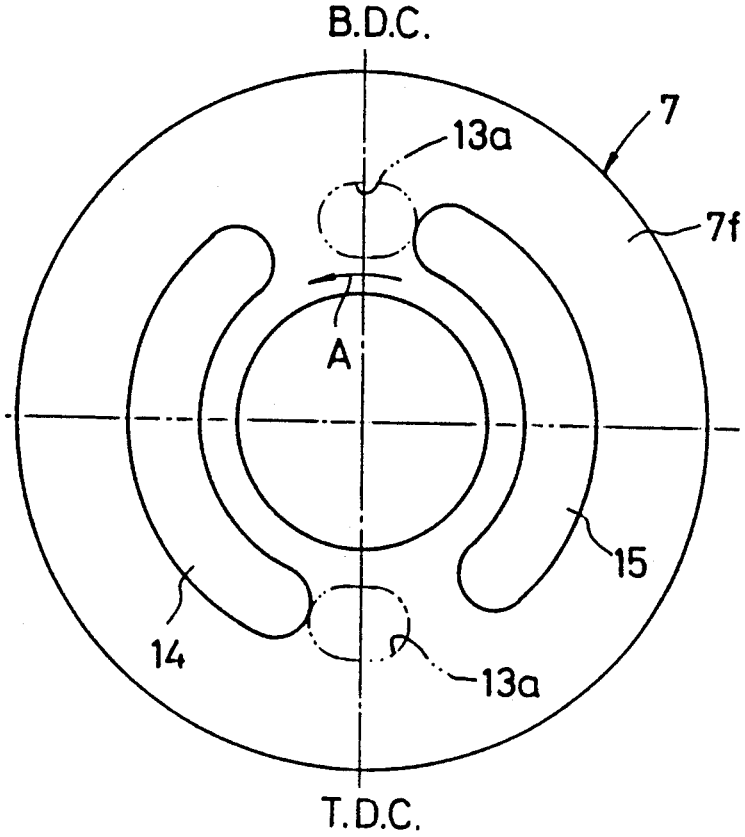
FIG. 3 is an elevational view taken along line III-III of FIG. 1.

As shown in FIG. 3, the distribution valve plate 7 has a single arcuate discharge port (outlet port) 14 defined in one side of the surface 7*f* and communicating with those connecting ports 13*a* which confront said one side of the surface 7*f*, and a single arcuate suction port (inlet port) 15 defined in the other side of the surface 7*f* and communicating with those connecting ports 13*a* which confront the other side of the surface 7*f*. The discharge and suction ports 14, 15 communicate respectively with discharge and suction passages 14*a*, 15*a* defined in the distribution valve plate 7.

Shoes 16 are angularly movably coupled to the distal ends of the respective plungers 12, and slidably held against the swash plate 6. To keep the shoes 16 in slidable contact with the swash plate 6, the shoes 16 are pressed against the swash plate 6 by a retainer plate 17 fastened to the swash plate holder 8.

When the input shaft 2 is rotated counterclockwise as viewed from the lefthand side of FIG. 1, the cylinder block 4 is also rotated counterclockwise. The shoe 16 coupled to the distal end of the plunger 12 which is positioned at its bottom dead center (BDC) in a most expanded state, for example, then slides up the tilted swash plate 6. The shoe and the plunger 12 coupled thereto are pushed by the swash plate 6 so that the plunger 12 enters the cylinder bore 11 in a discharge stroke. The hydraulic chamber 13 defined by the plunger 12 is now compressed, forcing working oil therein to flow under pressure into the discharge port 14 in the distribution valve plate 7. When the plunger 12 reaches its top dead center (TDC), it is in a most compressed state, completing the discharge stroke. Then, the shoe 16 slides down the tilted swash plate 6, allowing the plunger 12 coupled thereto to move in a direction out of the cylinder bore 13, whereupon a suction stroke begins. At this time, the hydraulic chamber 13 is expanded, drawing working oil under suction into the hydraulic chamber 13 from the suction port 15.

As shown in FIG. 3, the ends of the discharge and suction ports 14, 15 in the distribution valve plate 7 are spaced from each other by distances greater than the diameter of the connecting ports 13*a*. When a plunger 12 is positioned at its BDC, the corresponding connecting port 13*a* is held in contact with the suction port 15, but spaced from the discharge port 14, as indicated by the two-dot-and-dash line. When a plunger 12 is positioned at its TDC, the corresponding connecting port 13*a* is held in contact with the discharge port 14, but spaced from the suction port 15, as indicated by the two-dot-and-dash line.

Therefore, when a plunger 12 starts rotating from its BDC in the direction indicated by the arrow A (FIG. 3) upon rotation of the cylinder block 4, the corresponding hydraulic chamber 13 is held out of communication with the ports 14, 15 until the connecting port 13*a* communicating with the hydraulic chamber 13 reaches the discharge port 14. During this time, the working oil in the hydraulic chamber 13 is pre-compressed (i.e., its pressure is increased) by the plunger 12 as it moves in the compressing direction. Similarly, when a plunger 12 starts rotating from its TDC in the direction indicated by the arrow A (FIG. 3) upon rotation of the cylinder block 4, the corresponding hydraulic chamber 13 is held out of communication with the ports 14, 15 until the connecting port 13*a* communicating with the hydraulic chamber 13 reaches the suction port 15. During this time, the working oil in the hydraulic chamber 13 is pre-expanded (i.e., its pressure is reduced) by the plunger 12 as it moves in the expanding direction.

Figure 4:
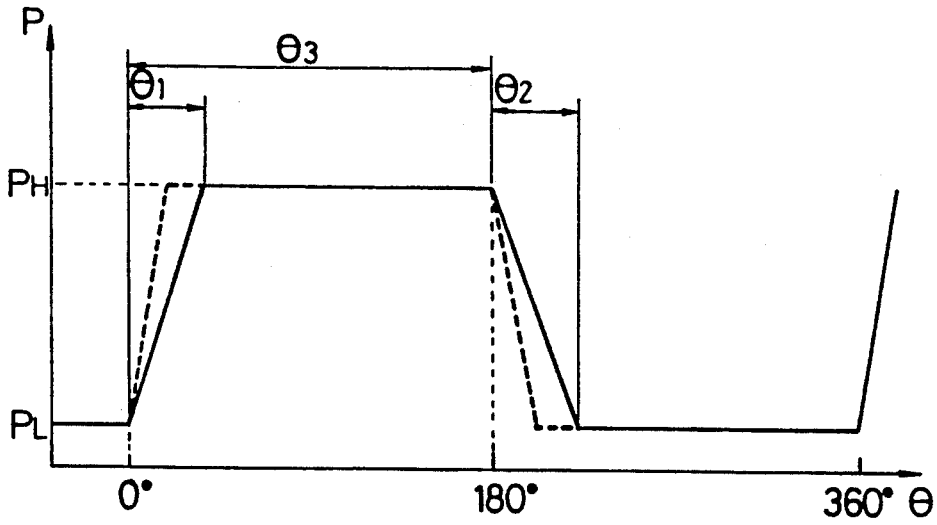
FIG. 4 is a graph showing the manner in which the hydraulic pressure in a hydraulic chamber varies as a cylinder block of the hydraulic pump rotates.
Figure 5:
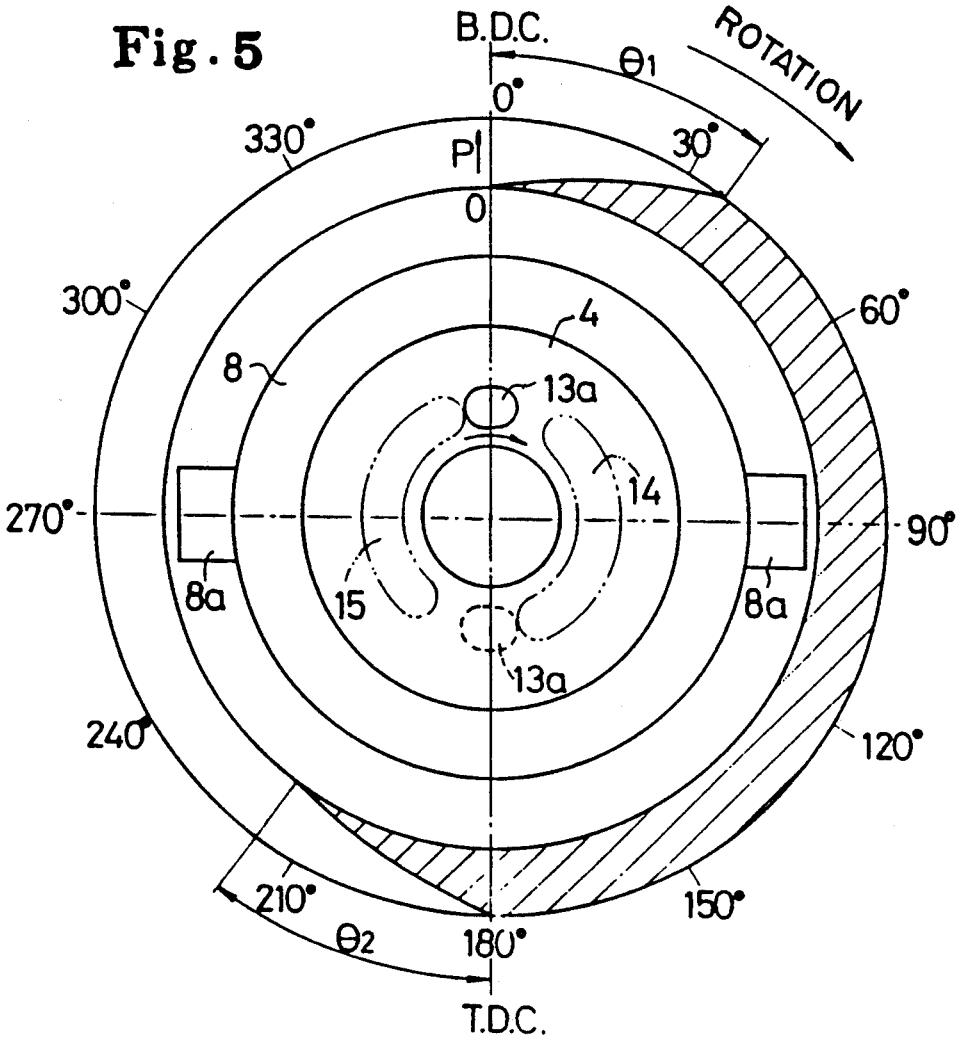
FIG. 5 is a diagram showing the manner in which the hydraulic pressure in the hydraulic chamber varies as the cylinder block rotates, and also showing the positions of ports.

The relationship between the position of the plunger 12 (i.e., the angular displacement of the cylinder block 4) and the hydraulic pressure in the hydraulic chamber 13 defined by the plunger 12 is shown in FIGS. 4 and 5. FIG. 5 shows the cylinder block 4 and the swash plate holder 8 as viewed in the direction indicated by the arrows II in FIG. 1. FIGS. 4 and 5 show the manner in which the hydraulic pressure P in the hydraulic chamber 13 defined by a plunger 12 at its BDC when the angular displacement $\theta$ of the cylinder block 4 is 0° varies as the angular displacement $\theta$ varies. An angular interval from the angular displacement 0° to the angular displacement $\theta 1$ is a pressure-increasing (pre-compressing) interval, and an angular interval from the angular displacement 180° to the angular displacement $\theta 2$ is a pressure-reducing (pre-expanding) interval. In this embodiment, the hydraulic pressure P gradually varies from a lower pressure PL to a higher pressure PH in the pressure-increasing interval, and the hydraulic pressure P gradually varies from the higher pressure PH to the lower pressure PL in the pressure-reducing interval.

According to the present embodiment, the discharge and suction ports 14, 15 are defined such that the angular displacement $\theta 1$ in which the hydraulic pressure in the hydraulic chamber 13 increases is equal to the angular displacement $\theta 2$ in which the hydraulic pressure in the hydraulic chamber 13 decreases. Furthermore, in the illustrated embodiment, the ports 14, 15 are defined such that an angular displacement $\theta 3$ from an angular position where the hydraulic pressure in the hydraulic chamber 13 starts to increase to an angular position where the hydraulic pressure in the hydraulic chamber 13 starts to decrease is selected to be:

$$\theta 3 = 180°$$

Figure 6:
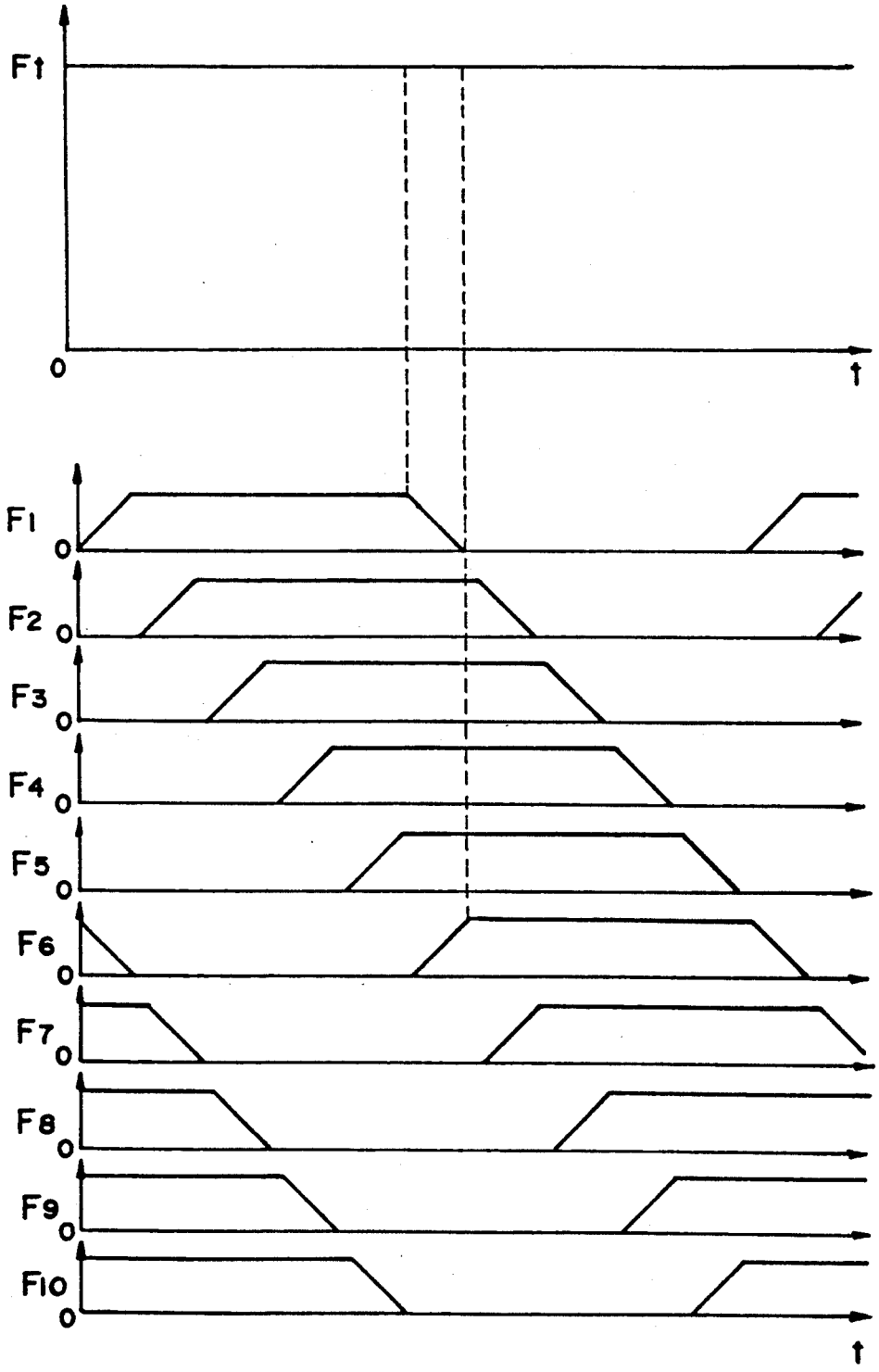
FIG. 6 is a graph showing how thrust loads acting on respective plungers and a total thrust load vary as the cylinder block rotates.

FIG. 6 shows how thrust loads F1 through F10 acting on the respective ten plungers 12 and a total Ft of these thrust loads vary with time as the cylinder block 4 rotates. It can be seen from FIG. 6 that any variations or fluctuations of the total thrust load Ft can theoretically be eliminated by selecting the angular displacements $\theta 1$, $\theta 2$, $\theta 3$.

Therefore, with the above arrangement, vibrating forces produced due to the total thrust load Ft can be reduced, thus suppressing vibration and noise of the hydraulic pump.

In the case of a variable displacement pump, the amount of change in pressure may vary when a tilting angle of the swash plate is changed. However, if the angular displacements $\theta 1$, $\theta 2$ and $\theta 3$ are as set as described above, the total thrust load Ft is not varied even if the tilting angle is changed. The angular displacements $\theta 1$ and $\theta 2$ may be better to be made as small as possible.

Any variation or fluctuation of the total thrust load Ft can be reduced by selecting the angular displacements $\theta 1$, $\theta 2$, $\theta 3$ as described above. However, it may be difficult to cause the hydraulic pressure to vary gradually in the pressure-increasing interval of the angular displacement $\theta 1$ and the pressure-reducing interval of the angular displacement $\theta 2$ as shown in FIGS. 4 and 5. To eliminate such difficulty, as shown in FIG. 7, a distribution valve plate 7' may have V-shaped grooves 14*a*, 15*a* at ends of discharge and suction ports 14, 15 to achieve the gradual change of the hydraulic pressure as shown in FIGS. 4 and 5.

The V-shaped grooves 14*a*, 15*a* may be replaced with holes or valves to obtain the hydraulic pressure change as shown in FIG. 4.

Figure 7:
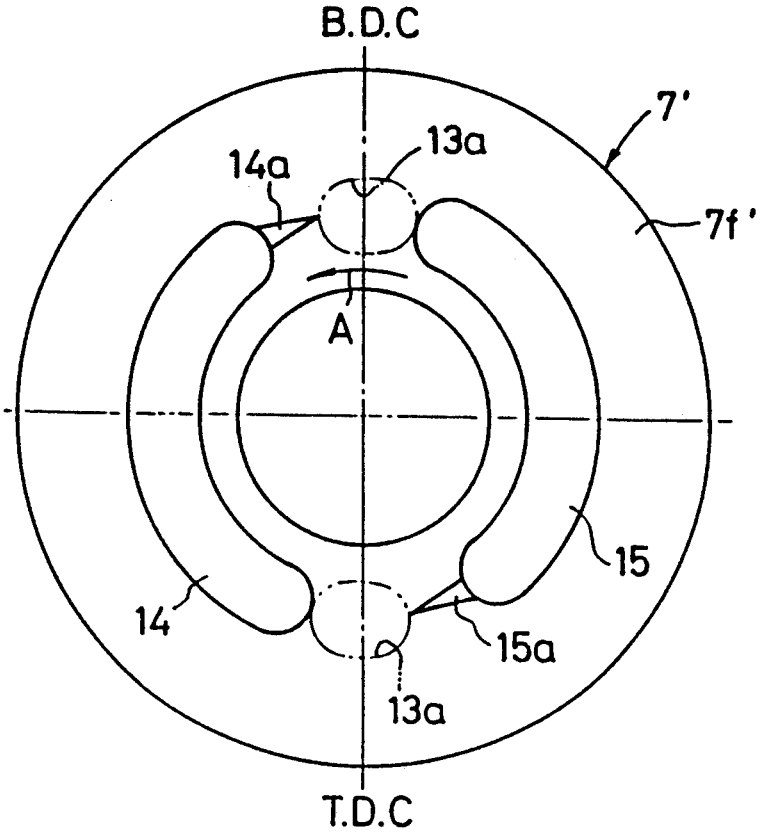
FIG. 7 is an elevational view of a different distribution valve plate.
Figure 8:
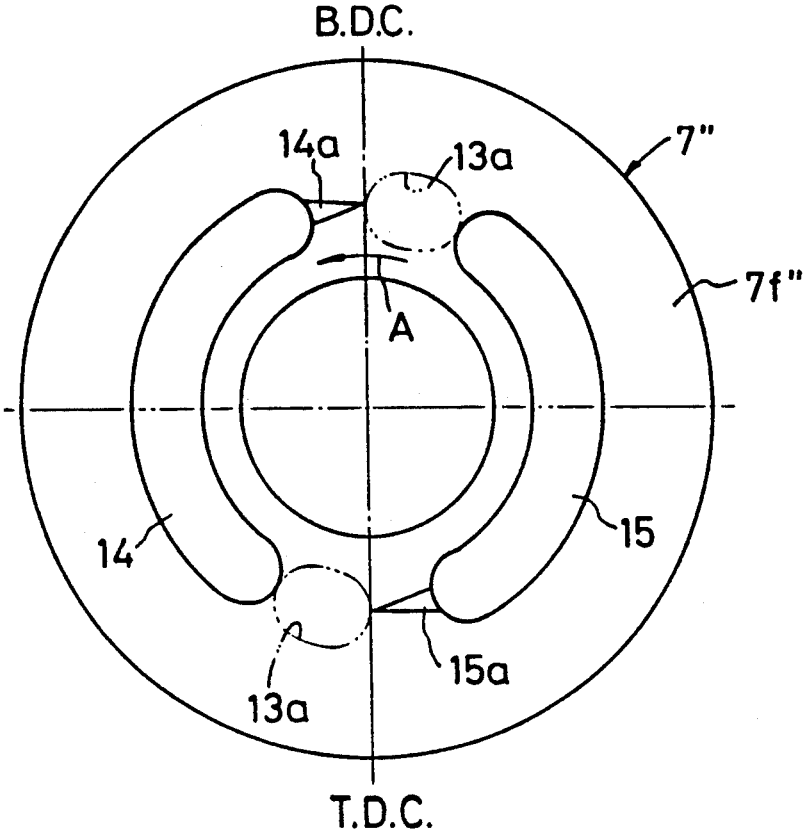
FIG. 8 is an elevational view of another different distribution valve plate.
Figure 9:
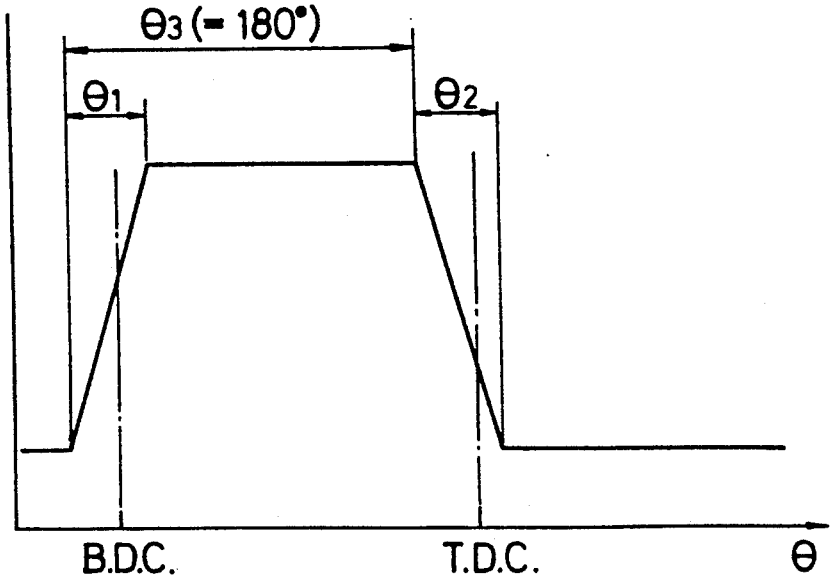
FIG. 9 is a graph showing the manner in which the hydraulic pressure in a hydraulic chamber varies as a cylinder block of the hydraulic pump rotates in a swash-plate plunger-type hydraulic pump which employs the distribution valve plate shown in FIG. 8.

In the arrangements shown in FIGS. 3 and 7, the hydraulic pressure in the hydraulic chamber 13 starts increasing or decreasing as the connecting port 13*a* starts moving from positions corresponding to the BDC or the TDC upon rotation of the cylinder block 4. However, the hydraulic pressure in the hydraulic chamber 13 starts increasing or decreasing as the connecting port 13*a* starts moving from positions different from the BDC or the TDC. For example, as shown in FIG. 8, discharge and suction ports 14, 15 may be defined in a distribution valve plate 7'' such that the hydraulic pressure in the hydraulic chamber 13 starts increasing or decreasing as the connecting port 13*a* starts moving from positions displaced off the BDC or the TDC in a direction shown in FIG. 8. With the discharge and suction ports 14, 15 being defined as shown in FIG. 8, the hydraulic pressure P in the hydraulic chamber 13 varies as shown in FIG. 9. In this case, the angular displacements $\theta 1$, $\theta 2$, $\theta 3$ are selected to satisfy the conditions "$\theta 1=\theta 2$" and "$\theta 3=180°$".

The position from which the connecting port 13*a* starts moving in starting to increase or decrease the hydraulic pressure in the hydraulic chamber 13 may be displaced off the BDC or the TDC in a direction opposite to the direction shown in FIG. 8.

A moment produced about the trunnion 8*a* will be considered below.

Figure 10:
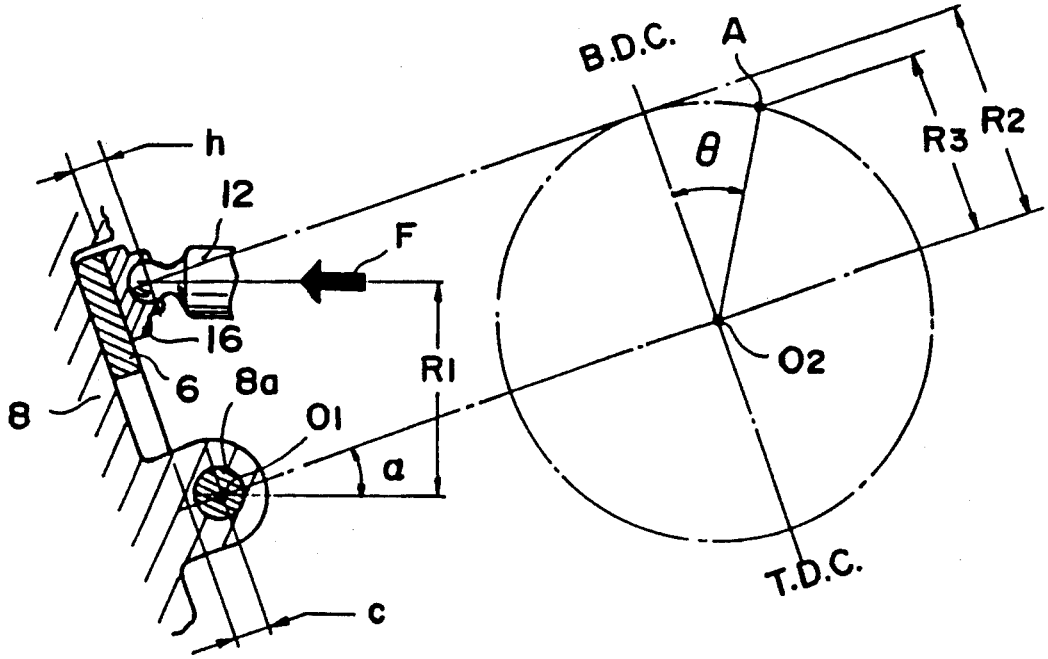
FIG. 10 is a schematic view showing a moment produced about a support shaft, by which a swash plate is tiltably supported, by a pushing force applied to a plunger in the hydraulic pump shown in FIG. 15.

As shown in FIG. 10, when a plunger 12 is in a position corresponding to the angular displacement $\theta$ from the BDC upon rotation of the cylinder block 4, a pressing force F is applied to the plunger 12, producing a moment M acting about the trunnion 8*a* on the swash plate 6 and the swash plate holder 8. The produced moment M is expressed as follows:

$$M=F\times R1\times\cos\theta\times\sec^2\alpha \quad (1)$$

where R1 is the length of the arm of the moment about the trunnion 8*a*, and $\alpha$ is the angle at which the swash plate 6 is tilted. As shown in FIG. 10, it is assumed that the radius of a circular path of the plunger 12 on the swash plate 6 is indicated by R2, and the distance on the swash plate 6 between the plunger 12 and the trunnion 8*a* when the plunger 12 is in a position corresponding to the angular displacement $\theta$ from the BDC is indicated by R3. Then, the radius R2 is given by:

$$R2=R1\times\sec\alpha.$$

Since the distance R3 is expressed as:

$$R3=R2\times\cos\theta,$$

it is written as:

$$R3=R1\times\cos\theta\times\sec\alpha.$$

Since the moment M is given by:

$$M=F\times\sec\alpha\times R3,$$

the moment M can be defined by the equation (5).

The distance h from the center of the distal end of the plunger 12 about which the shoe 16 is angularly movable to the sliding surface of the swash plate 6, is equal to the distance c from the center O1 of the trunnion 8*a* to the sliding surface of the swash plate 6. The center O1 of the trunnion 8*a* is aligned with the center O2 of the circular path of the plunger 12 on the sliding surface of the swash plate 6.

The moment M defined by the equation (1) is based on the pressing force F acting on a single plunger 12. The respective moments M acting on all the plungers 12 are added to determine a total moment Mt acting about the trunnion 8*a*.

Figure 12:
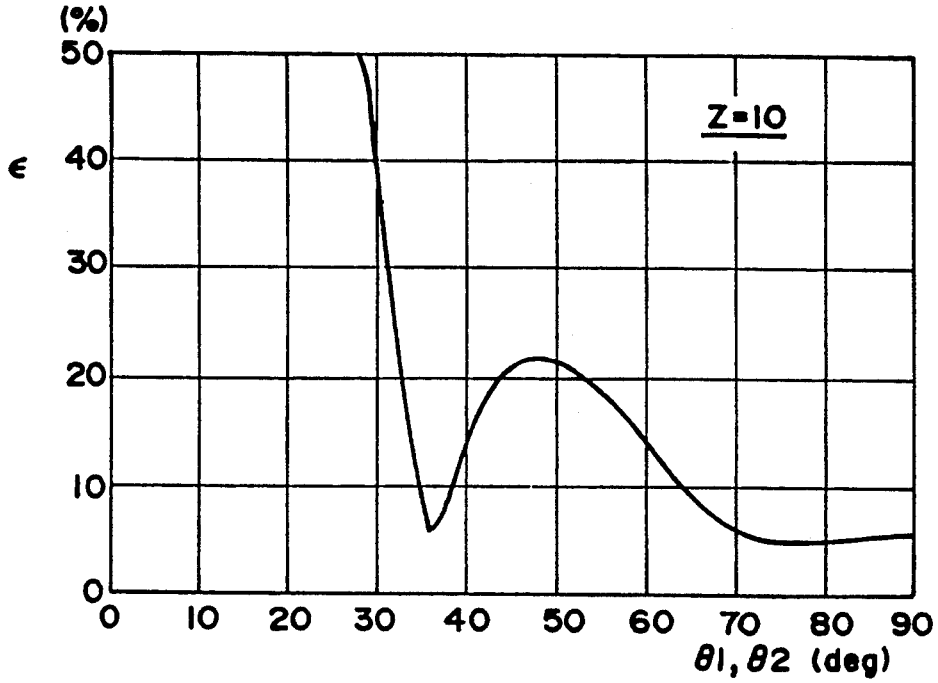
FIGS. 12 and 13 are graphs showing the relationship between an angular displacement $\theta 1$ in which the hydraulic pressure in the hydraulic chamber increases, an angular displacement $\theta 2$ in which the hydraulic pressure in the hydraulic chamber decreases, and a fluctuating ratio of the total moment.
Figure 13:
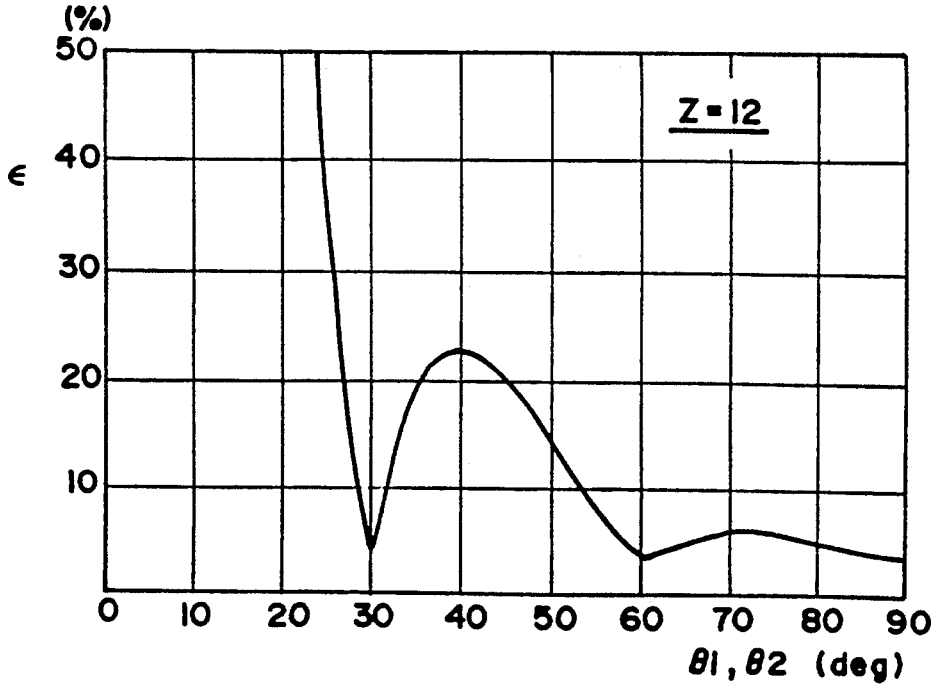

FIG. 12 shows pulsating ratio $\epsilon$ of the total thrust moment Mt at certain angular displacements when the angular displacements $\theta 1$, $\theta 2$ vary from 0° to 90°, with the number Z of plungers 12 being 10, and FIG. 13 shows such pulsating ratios $\epsilon$ with the number Z of plungers 12 being 12. Review of FIGS. 12 and 13 indicate that the pulsating ratio $\epsilon$ becomes minimum when the angular displacements $\theta 1$, $\theta 2$ are given according to $360°/Z\times k$ (k is an integer). For example, if $Z=10$, then the pulsating ratio $\epsilon$ becomes minimum at angles which are a multiple of 36° by k, i.e., $\theta 1=\theta 2=36°$ (k=1), 72° (k=2).

If $Z=12$, the pulsating ratio $\epsilon$ becomes minimum at angles which are a multiple of 30° by k, i.e., $\theta 1=\theta 2=30°$ (k=1), 60° (k=2).

Therefore, in order to reduce the total moment Mt, the discharge and suction ports 14, 15 should be defined such that the following equation is satisfied:

$$\theta 1=\theta 2=360°/Z\times k \quad (2)$$

where

Z: the number of plungers (even number); and k=1, 2, 3, . . . (integer), and $$\theta 3=180°. \quad (3)$$

Figure 11:
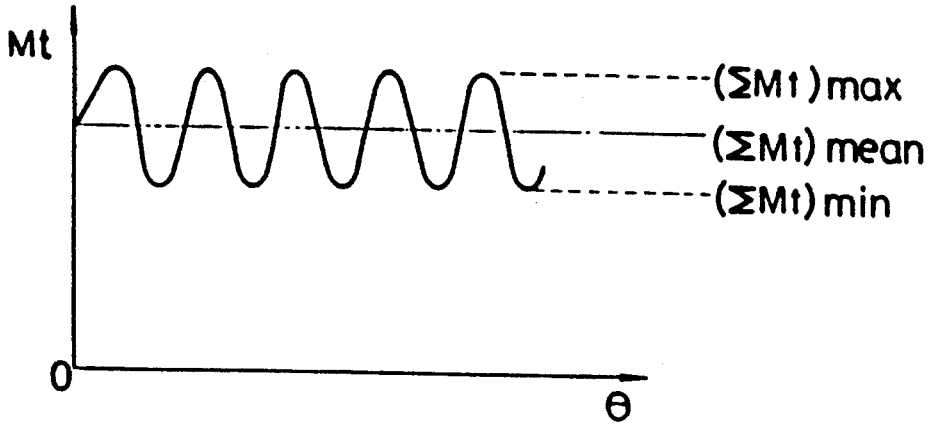
FIG. 11 is a graph showing the manner in which a total moment Mt about the support shaft varies.

When the total moment Mt varies or fluctuates as shown in FIG. 11, the pulsating ratio $\epsilon$ of the total moment Mt is determined as follows:

$$\Sigma=\{(\Sigma Mt)\max-(\Sigma Mt)\min\}/(\Sigma Mt)\text{mean}\times 100(\%).$$

Figure 14A:
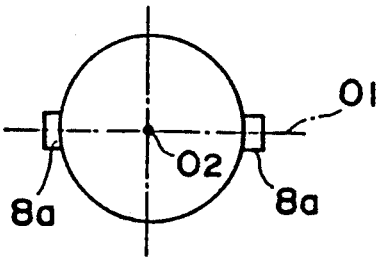
FIGS. 14(A) and 14(B) are schematic views showing the positional relationship between a center 01 of the support shaft on the swash plate and a center 02 about which the plungers rotate.
Figure 14B:
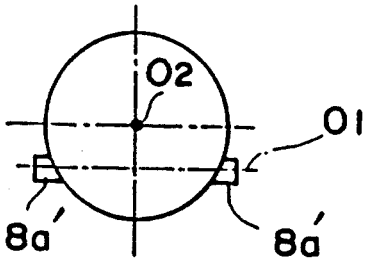

In the calculation of the total moment Mt, it is assumed that the center O1 of the trunnion 8*a* is aligned with the center O2 of the circular path of the plunger 12 on the sliding surface of the swash plate 6, as shown in FIG. 14(A). However, even if the center O1 of the trunnion 8*a* is offset from the center O2 of the circular path of the plunger 12, as shown in FIG. 14(B), the angular displacements $\theta 1$, $\theta 2$ have the same values as those shown in FIGS. 12 and 13 for minimizing the total moment Mt, though the total moment Mt has a different absolute value.

Figure 15:
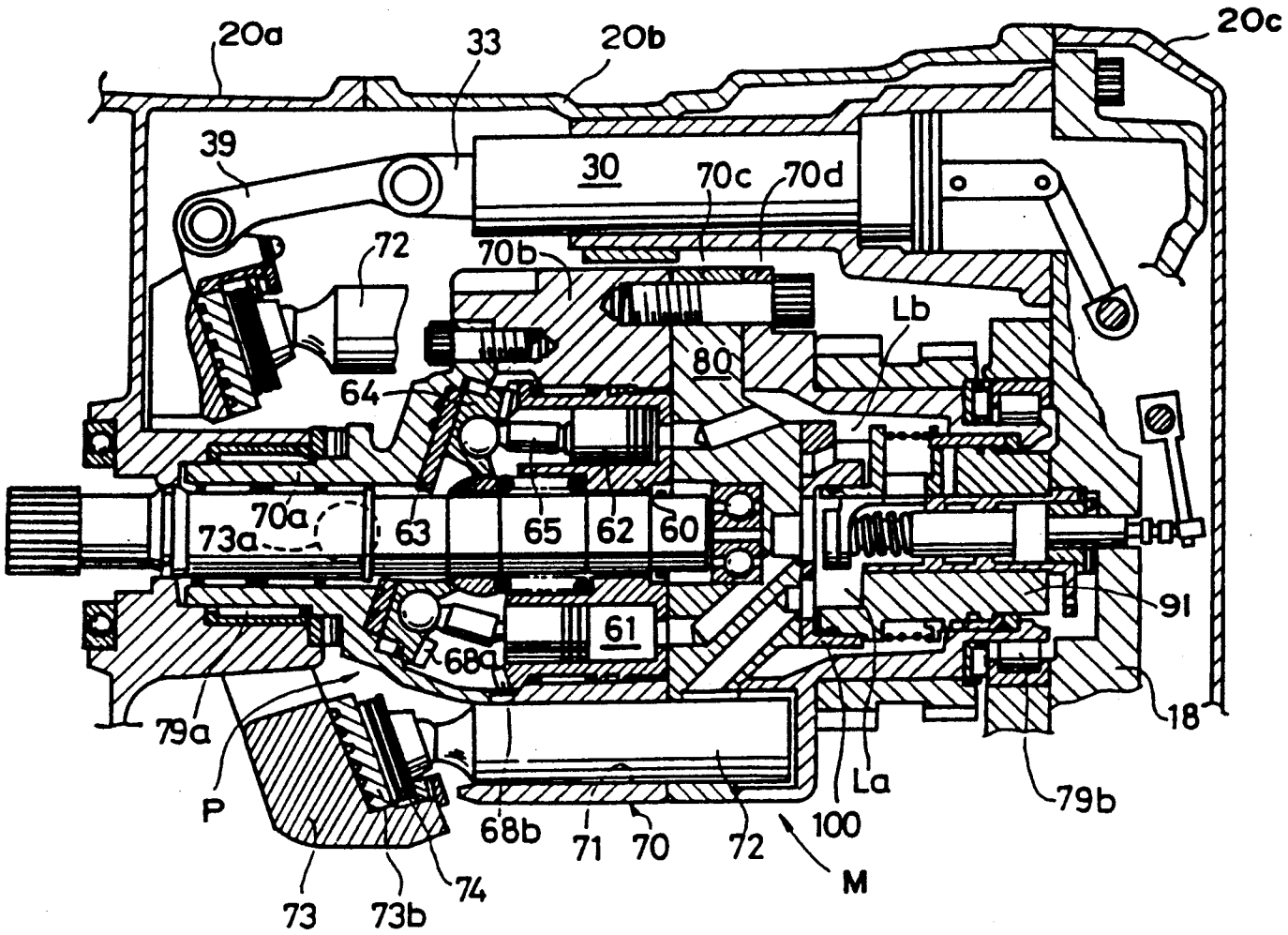
FIG. 15 is an axial cross-sectional view of a hydraulically operated continuously variable transmission which comprises the hydraulic pump and motor according to the present invention.
Figure 16:
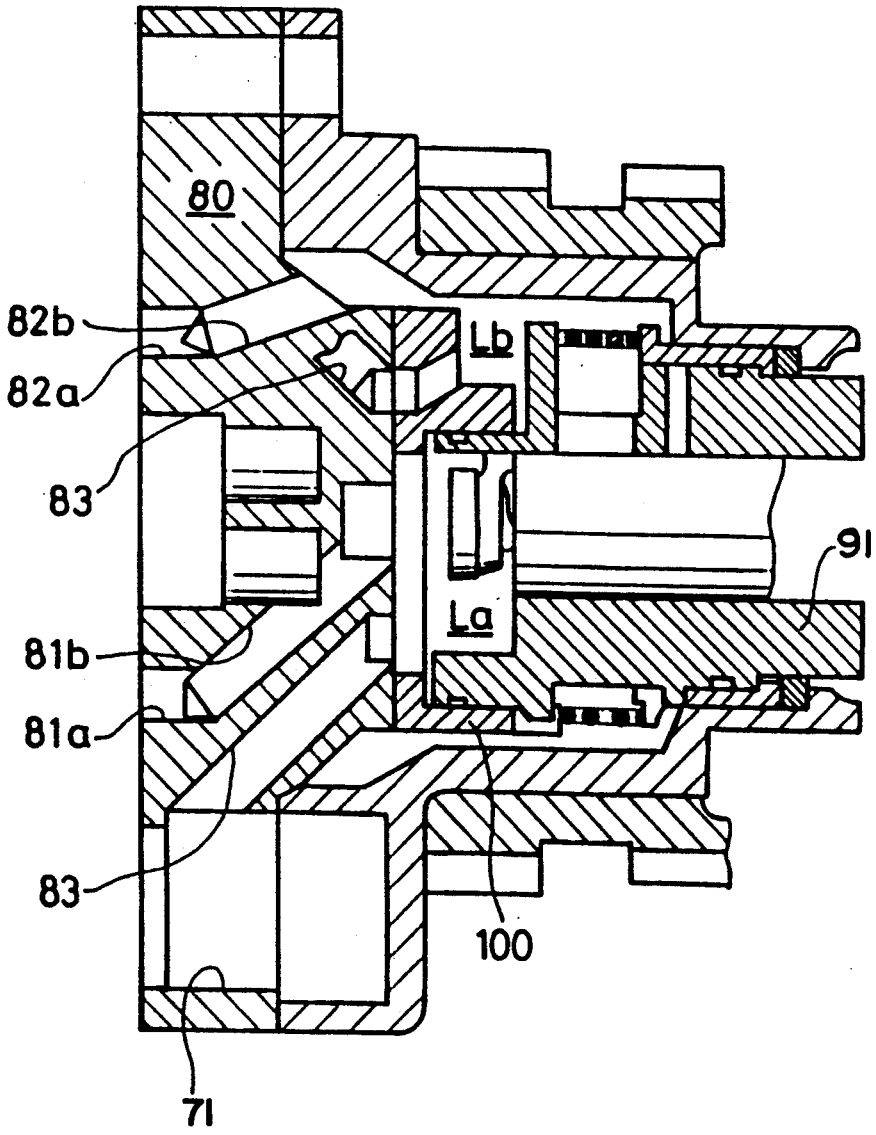
FIG. 16 is a fragmentary cross-sectional view of a portion of the hydraulically operated continuously variable transmission shown in FIG. 15.

Any variation or fluctuation of the total moment Mt can be reduced by selecting the angular displacements $\theta 1$, $\theta 2$, $\theta 3$ as shown by the equations (1) and (2). However, it may be difficult to cause the hydraulic pressure to vary gradually in the pressure-in-creasing interval of the angular displacement $\theta 1$ and the pressure-reducing interval of the angular displacement $\theta 2$ as shown in FIGS. 4 and 5. To eliminate such difficulty, as shown in FIG. 7, a distribution valve plate 7' may have V-shaped grooves 14*a*, 15*a* at ends of discharge and suction ports 14, 15 to achieve the gradual change of the hydraulic pressure as shown in FIGS. 15 and 16.

The principles of the present invention are incorporated in a swash-plate plunger-type hydraulic pump in the above embodiment, but may be embodied in a swash-plate plunger-type hydraulic motor.

In the illustrated embodiment, the swash-plate plunger-type hydraulic pump is of the variable displacement type wherein the swash plate is tiltable through different angles. However, the swash-plate plunger-type hydraulic pump may be of the fixed displacement type.

The above first embodiment has been described with respect to a swash-plate plunger-type hydraulic pump or motor only. However, a swas-plate plunger-type hydraulic pump and a swash-plate plunger-type hydraulic motor of the above arrangement may be combined into a hydraulically operated continuously variable transmission.

FIG. 15 shows such a hydraulically operated continuously variable transmission by way of example. The hydraulically operated continuously variable transmission shown in FIG. 15 includes a hydraulic pump P and a hydraulic motor M which are coaxially disposed in a space surrounded by transmission cases 20*a*, 20*b*, 20*c*. The hydraulic pump P has an input shaft 21 coupled to the output shaft of an engine.

The hydraulic pump P comprises a pump cylinder 60 splined to the input shaft 21 and having a plurality of equally angularly spaced cylinder bores 61 arranged along a common circle, and a plurality of pump plungers 62 slidably fitted in the respective cylinder bores 61. The pump cylinder 60 is rotatable by the power of the engine transmitted through the input shaft 21.

The hydraulic motor M comprises a motor cylinder 70 surrounding the pump cylinder 60 and having a plurality of equally angularly spaced cylinder bores 71 arranged along a common circle, and a plurality of motor plungers 72 slidably fitted in the respective cylinder bores 71. The motor cylinder 70 is rotatable coaxially with the pump cylinder 60 relatively thereto.

The motor cylinder 70 comprises first through fourth cylinder segments 70*a* through 70*d* which are axially arranged and fastened securely together. The first cylinder segment 70*a* has a lefthand end (as shown) rotatably supported in the case 20*a* by a bearing 79*a* and a righthand end inclined to the input shaft 21 and serving as a pump swash plate holder in which a tilted pump swash plate ring 63 is mounted. The second cylinder segment 70*b* has the cylinder bores 71 defined therein. The third cylinder segment 70*c* has a distribution disk 80 having hydraulic passages in communication with the cylinder bores 61, 71. The fourth cylinder segment 70*d* is coupled to the third cylinder segment 70*c*, and rotatably supported in the case 20*b* by a bearing 79*b*.

An annular pump shoe 64 is slidably mounted on the pump swash plate ring 63, and angularly movably coupled to the pump plunger 62 through connecting rods 65, respectively. The pump shoe 64 and the pump cylinder 60 have respective bevel gears 68*a*, 68*b* meshing with each other. Therefore, when the pump cylinder 60 is rotated by the input shaft 1, the pump shoe 64 is also rotated in unison therewith. Because the pump swash plate ring 63 is tilted, the pump plungers 62 are reciprocally moved in the cylinder bores 61, drawing working oil from a suction port and discharging working oil into a discharge port.

A swash plate holder 73 positioned in axially confronting relation to the motor plungers 72 is angularly movably supported in the cases 20*a*, 20*b* by a pair of trunnions (support shafts) 73*a* which project from outer ends of the swash plate holder 73 in directions normal to the sheet of FIG. 13. A motor swash plate ring 73*b* is mounted on the surface of the swash plate holder 73 which faces the motor plungers 72. Motor shoes 74 are slidably mounted on the motor swash plate ring 73*b*, and angularly movably coupled to the respective distal ends of the motor plungers 72. The swash plate holder 73 is coupled, at an end remote from the trunnions 73*a*, to a piston rod 33 of a servo unit 30 through a link 39. When the servo unit 30 is actuated, the piston rod 33 is axially moved to cause the swash plate holder 73 to swing about the trunnions 73*a* for varying a speed reduction ration (described later on).

The fourth cylinder segment 70*d* is of a hollow structure, and a fixed shaft 91 fixed to a pressure distribution member 18 is disposed centrally in the hollow fourth cylinder segment 70*d*. a distribution ring 100 is fitted over the lefthand end (as shown) of the fixed shaft 91 in a fluid-tight fashion. The distribution ring 100 has a lefthand end surface slidably held against the distribution disk 80. The distribution ring 100 divides the hollow space in the fourth cylinder segment 70*d* into a radially inner first hydraulic passage La and a radially outer second hydraulic passage Lb.

The distribution disk 80 and the structure within the fourth cylinder segment 70*d* are shown in detail in FIG. 16.

The distribution disk 80 has a pump discharge port 81*a* defined therein, a pump suction port 82*a* defined therein, a pump discharge passage 81*b* defined therein communicating with the pump discharge port 81*a*, and a pump suction passage 82*b* defined therein and communication with the pump suction port 82*a*. The cylinder bores 61 housing those pump plungers 62 that are in a discharge stroke communicate with the radially inner first hydraulic passage La through the pump discharge port 81*a* and the pump discharge passage 81*b*. The cylinder cores 61 housing those pump plungers 62 that are in a suction stroke communicate with the radially outer second hydraulic passage Lb through the pump suction port 82*a* and the pump suction passage 82*b*. The distribution disk 80 also has as many connecting passages 83 as the number of the plungers 72, the connecting passages 83 communicating with the respective cylinder bores 71 which house the respective motor plungers 72. The connecting passages 83 have open ends that communicate with the first hydraulic passage La or the second hydraulic passage Lb through the distribution ring 100 upon rotation of the motor cylinder 70. The cylinder bores 71 housing those motor plungers 72 which are in an expansion stroke are held in communication with the first hydraulic passage La through the connecting passages 83, and the cylinder bores 71 housing those motor plungers 72 which are in a compression stroke are held in communication with the second hydraulic passage Lb through the connecting passages 83.

In this manner, a closed hydraulic circuit is established between the hydraulic pump P and the hydraulic motor M through the distribution disk 80 and the distribution ring 100. When the pump cylinder 60 is rotated by the input shaft 21, working oil under pressure is discharged by those pump plungers 62 in a discharge stroke, and flows into the cylinder bores 71 housing those motor plungers 72 which are in the expansion stroke, through the pump discharge port 81*a*, the pump discharge passage 81*b*, the first hydraulic passage La, and the connecting passages 83 communicating with the first hydraulic passage La. Working oil discharged by those motor plungers 72 which are in the compression stroke flows into the cylinder bores 61 housing those pump plungers 62 which are in a suction stroke, through the connecting passages 83 communicating with the second hydraulic passage Lb, the second hydraulic passage Lb, the pump suction passage 82*b*, and the pump suction port 82*a*.

While the working oil is thus circulating, the motor cylinder 70 is rotated by the sum of a reactive torque that is applied to the motor cylinder 70 by those pump plungers 62 in the discharge stroke through the pump swash plate ring 63 and a reactive torque that is applied to those motor plungers 72 which are in the expansion stroke by the motor swash plate holder 73.

The speed reduction ratio i, i.e., the ratio of the rotational speed of the motor cylinder 70 to the rotational speed of the pump cylinder 60, is given as follows:

i = (rotational speed of the pump cylinder 60)/(rotational speed of the motor cylinder 70)
= 1 + (displacement of the hydraulic motor M)/(displacement of the hydraulic pump P).

As seen from the above equation, when the swash plate holder 73 is angularly moved by the servo unit 30 to vary the displacement of the hydraulic motor M from 0 to a certain value, the speed reduction ratio i can continuously be varied from 1 (minimum value) to a certain ratio (maximum value).

Figure 17:
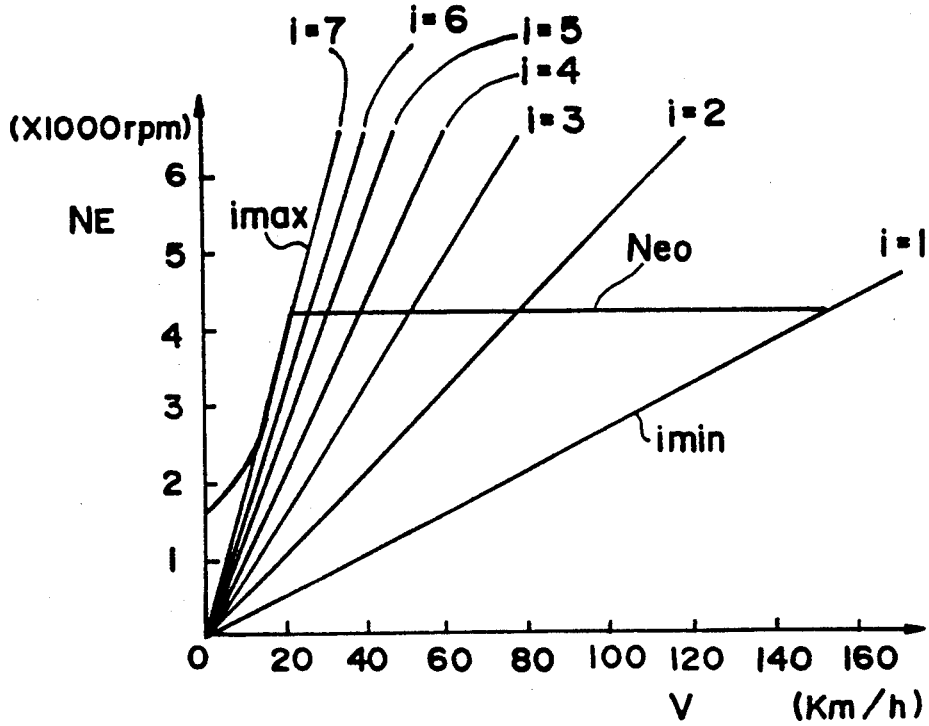
FIG. 17 is a graph showing the relationships between an engine speed "$N_E$", a vehicle speed "V" and a speed reduction ratio "i" in the above continuously variable transmission.

In the above hydraulically operated continuously variable transmission, the speed reduction ratio i is controlled by the servo unit 30 so that an actual engine speed $N_E$ coincides with a reference engine speed Neo, the reference engine speed Neo being set based on an accelerator opening. For example, as shown in FIG. 17, when the reference engine speed Neo is set to be 4200 rpm, the speed reduction ratio i is so controlled as to continuously decrease from maximum to minimum (=1.0) while the actual engine speed $N_E$ is kept at 4200 rpm.

Figure 18:
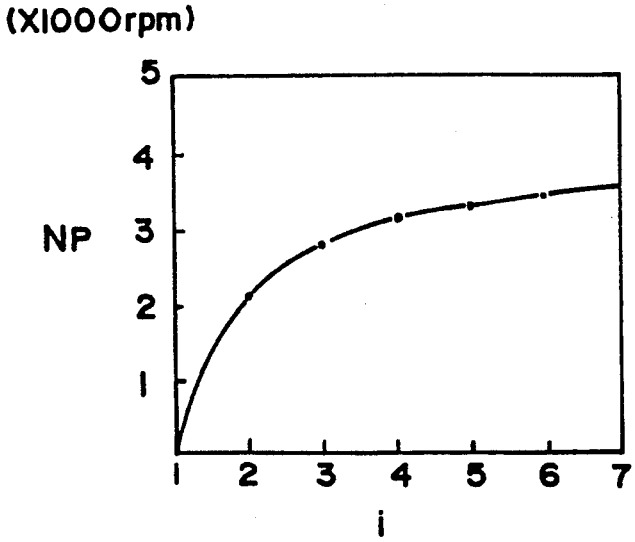
FIG. 18 is a graph showing the relationship between a pump rotational speed "$N_P$" and a speed reduction ratio "i" in the above continuously variable transmission.
Figure 19:
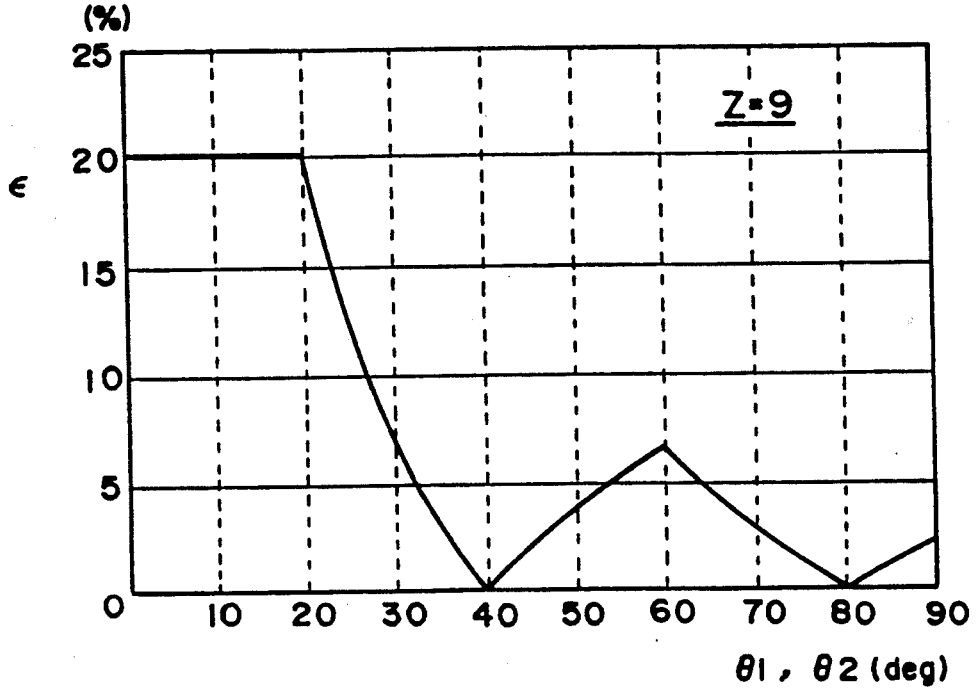
FIG. 19 is a graph showing the relationships between an angular displacement $\theta 1$ in which the hydraulic pressure in a hydraulic chamber increases, an angular displacement $\theta 2$ in which the hydraulic pressure in a hydraulic chamber decreases and a fluctuating ratio of the total moment in a hydraulic pump with an odd number of plungers.

Since the pump swash plate holder is connected integrally with the motor cylinder 70, the rotational speed $N_p$ of the pump P (the relative rotational speed of the pump cylinder 60 to the pump swash plate ring 63) continuously varies from 3600 rpm to 0 rpm as shown in FIG. 18, theoretically.

As described above, in the hydraulically operated continuously variable transmission according to the present embodiment, the pump rotational speed $N_p$ varies drastically though the engine speed is being kept constant. As a result, the amount of fluid sucked and discharged by the pump P greatly varies, and therefore a pressure loss caused during discharging stroke also greatly varies. Therefore the angular displacement $\theta 1$ in which the hydraulic pressure increases and the angular displacement $\theta 2$ in which the hydraulic pressure decreases vary. It is difficult to maintain them constant.

Figure 21:
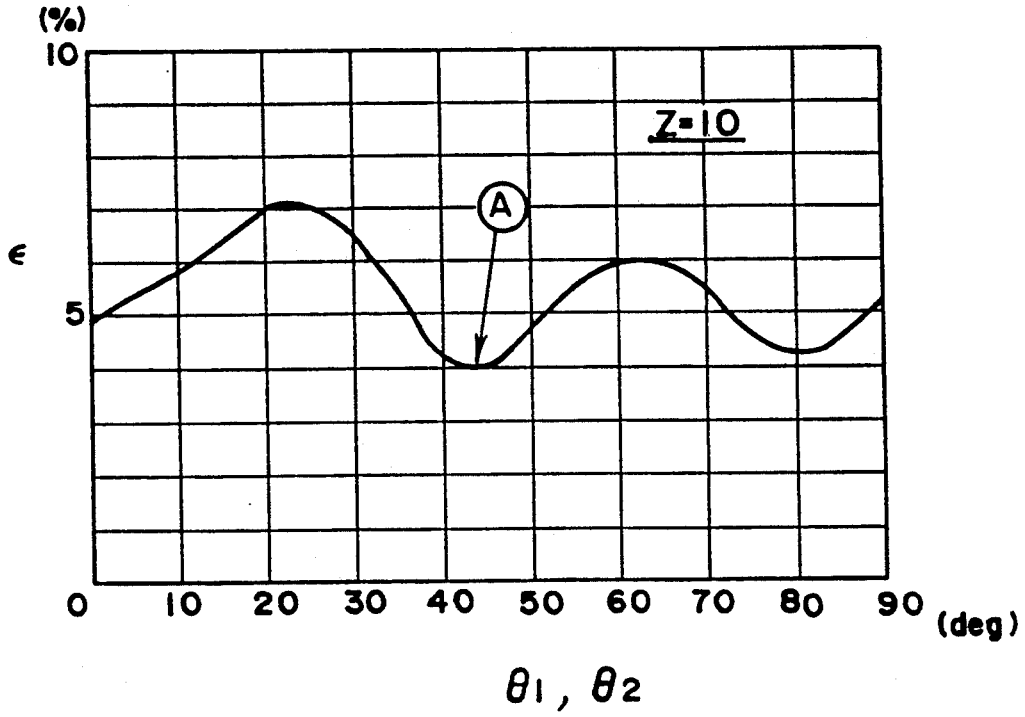
FIG. 21 is a graph showing the relationships between an angular displacement $\theta 1$ in which the hydraulic pressure in the hydraulic chamber increases, an angular displacement $\theta 2$ in which the hydraulic pressure in the hydraulic chamber decreases, and a pulsating ratio $\epsilon$ in the hydraulic pump according to a second embodiment.

If the number of the pump plungers is an odd number, for example, nine, the total thrust load Ft varies as shown in FIG. 21. FIG. 21 shows the fluctuation ratio $\epsilon$ of the total thrust load Ft at some angular displacements when the angular displacements $\theta 1$, $\theta 2$ vary from 0° to 90°. Study of FIG. 21 indicates that the ratio $\epsilon$ becomes substantially zero when the angular displacement $\theta 1$ and $\theta 2$ are equal to 40° or 80°. However, when these angular displacements $\theta 1$ and $\theta 2$ are varied, the ratio is also varied. Accordingly, if the number of the pump plungers 62 is odd, the fluctuation ratio $\epsilon$ of the total thrust load tends to become large, thereby noise from the transmission being increased.

However, in the present embodiment, the number of the pump plungers 62 of the hydraulic pump P is ten (even number) and $\theta 1 = \theta 2$. In this transmission, even if the angular displacements $\theta 1$ and $\theta 2$ are varied, the total thrust load Ft does not vary. Accordingly in the transmission according to the present invention, fluctuating forces produced due to the total thrust load Ft can be reduced, thus suppressing noise of the transmission.

Figure 20:
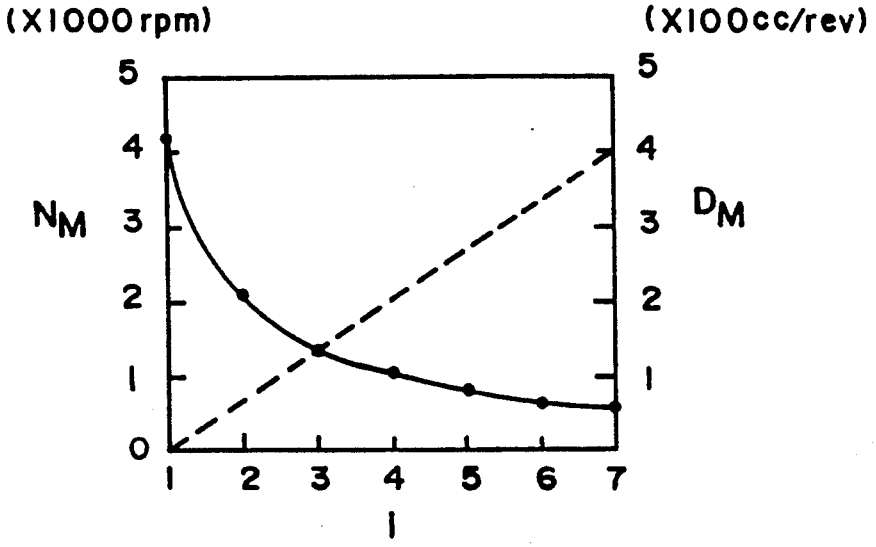
FIG. 20 is a graph showing the relationships between a motor rotational speed "$N_M$", a displacement of a motor plunger "$D_M$" and a speed reduction ration in the above continuously variable transmission.

The hydraulic motor M of the above hydraulically operated continuously variable transmission also has an even number (i.e. ten) of motor plungers 72. The fluctuating forces produced by the total thrust load Ft is also reduced in the motor M, thus suppressing noise. Particularly, the hydraulic motor is of variable displacement type wherein the swash plate holder 73 is tiltable around the trunion shaft 73*a*. As shown in FIG. 20, the displacement volume $D_M$ of the motor plunger 72 as well as the rotational speed $N_M$ of the motor M varies in correspondence with the speed reduction ratio i. The angular displacement $\theta 1$ and $\theta 2$ in the motor M is much greater than in the pump P. Accordingly, it is very effective to make the number of the motor plungers 72 even to reduce noise.

Further, when the above hydraulically operated continuously variable transmission is mounted on a vehicle, during coasting, the hydraulic motor M operates as a pump and the hydraulic pump P operates as a motor, thereby engine brake being produced. Hydraulic pressures in the cylinders 61, 67 and the angular displacements $\theta 1$, $\theta 2$ during accelerating are greatly different from those during coasting. But, if the numbers of the pump plungers 62 and the motor plungers 72 are even numbers, the fluctuation of the total thrust load Ft can be minimized, to suppress noise from the transmission.

In the case where the hydraulically operated continuously variable transmission composed of the hydraulic pump P and the hydraulic motor M is used as the transmission of a motor vehicle, while the motor vehicle is running at high speed, the hydraulic motor M also rotates at high speed. When the total moment Mt produced by pressing forces from the motor plungers 72 fluctuates, the variation of the total moment Mt is applied as a vibrating force to the swash plate holder 73, causing the transmission to produce high-frequency noise. Such high-frequency noise can be prevented from being generated when the ports of the hydraulic motor M are defined to satisfy the equations (2) and (3) above to minimize any fluctuation of the total moment Mt.

Since the angular displacements $\theta 1$ and $\theta 2$ vary in correspondence with a rotational speed of the motor M and a tilting angle of the swash plate holder, the ports are defined so that the angular displacements $\theta 1$ and $\theta 2$ satisfy the equations (2) and (3) at a rotational speed and a tilting angle of the motor during running at high speed. For example, they are defined so as to be $\theta 1=\theta 2=36°$ and $\theta 3=180°$.

If the angular displacements $\theta 1$, $\theta 2$ are increased, then the volumetric efficiencies of the hydraulic motor and pump are lowered. In the hydraulically operated continuously variable transmission shown in FIGS. 15 and 16, however, while the motor vehicle is running at high speed, since the swash plate holder 73 is tilted nearly at a minimum angle (where the speed reduction ratio $i=1$), the ratio of hydraulic power transmission is relatively small, and hence any reduction in the power transmitting efficiency of the transmission is relatively small. Therefore, the hydraulically operated continuously variable transmission incorporating the principles of the present invention can effectively prevent the generation of high-frequency noise without lowering the power transmitting efficiency.

The power transmitting efficiency will be reviewed in greater detail below.

The ratio of hydraulic power transmission (hydraulic pressure transmission ratio) in the hydraulically operated continuously variable transmission is expressed by:

$$\text{Hydraulic pressure transmission ratio} = 1 - (1/i)$$

Where i is the speed reduction ratio=(input rotational speed)/(output rotational speed).

The ratio of mechanical power transmission (mechanical transmission ratio) is given by:

$$\text{Mechanical power transmission ratio} = 1/i.$$

If ten plungers are employed, and the ports are defined so that $\theta 1=\theta 2=36°$, then the hydraulic pressure transmission is reduced by about 6.5%. Therefore, the overall power transmitting efficiency $\eta$ of the hydraulic pump itself as shown in FIG. 1 is 93.5%.

The overall power transmitting efficiency $\eta$ of the hydraulically operated continuously variable transmission shown in FIG. 15 is:

$$\eta\ \{(\text{mechanical transmission ratio}) + (\text{hydraulic pressure transmission ratio} \times 0.935\} \times 100 = \{(1/i) + (1 - 1/i) \times 0.935\} \times 100.$$

Therefore, when the speed reduction ratio is $i=1.5$, for example, the overall power transmitting efficiency is $\eta=97.8\%$. The hydraulically operated continuously variable transmission can be operated with a higher efficiency than the hydraulic pump itself. Stated otherwise, the hydraulic device according to the present invention is highly advantageous from the standpoint of efficiency if incorporated in hydraulically operated continuously variable transmissions.

EMBODIMENT 2

A second embodiment of the present invention will be described below. The second embodiment is also embodied in the hydraulic pump shown in FIG. 1.

According to the second embodiment, as with the hydraulic pump according to the first embodiment, as shown in FIG. 3, the ends of the discharge and suction ports 14, 15 in the distribution valve plate 7 are spaced from each other by distances greater than the diameter of the connecting ports 13*a*. When a plunger 12 is positioned at its BDC, the corresponding connecting port 13*a* is held in contact with the suction port 15, but spaced from the discharge port 14, as indicated by the two-dot-and-dash line. When a plunger 12 is positioned at its TDC, the corresponding connecting port 13*a* is held in contact with the discharge port 14, but spaced from the suction port 15, as indicated by the two-dot-and-dash line.

Therefore, when a plunger 12 starts rotating from its BDC in the direction indicated by the arrow A (FIG. 3) upon rotation of the cylinder block 4, the corresponding hydraulic chamber 13 is held out of communication with the ports 14, 15 until the connecting port 13*a* communicating with the hydraulic chamber 13 reaches the discharge port 14. During this time, the working oil in the hydraulic chamber 13 is pre-compressed (i.e., its pressure is increased) by the plunger 12 as it moves in the compressing direction. Similarly, when a plunger 12 starts rotating from its TDC in the direction indicated by the arrow A (FIG. 3) upon rotation of the cylinder block 4, the corresponding hydraulic chamber 13 is held out of communication with the ports 14, 15 until the connecting port 13*a* communicating with the hydraulic chamber 13 reaches the suction port 15. During this time, the working oil in the hydraulic chamber 13 is pre-expanded (i.e., its pressure is reduced) by the plunger 12 as it moves in the expanding direction.

The relationship between the position of the plunger 12 (i.e., the angular displacement of the cylinder block 4) and the hydraulic pressure in the hydraulic chamber 13 defined by the plunger 12 is shown in FIGS. 4 and 5. FIGS. 4 and 5 show the manner in which the hydraulic pressure P in the hydraulic chamber 13 defined by a plunger 12 at its BDC when the angular displacement $\theta$ of the cylinder block 4 is 0° varies as the angular displacement $\theta$ varies. An angular interval from the angular displacement 0° to the angular displacement $\theta 1$ is a pressure-increasing (pre-compressing) interval, and an angular interval from the angular displacement 180° to the angular displacement $\theta 2$ is a pressure-reducing (pre-expanding) interval. In this embodiment, the hydraulic pressure P gradually varies from a lower pressure PL to a higher pressure PH in the pressure-increasing interval, and the hydraulic pressure P gradually varies from the higher pressure PH to the lower pressure PL in the pressure-reducing interval.

In the second embodiment, the discharge and suction ports 14, 15 are defined such that the angular displacements $\theta 1$, $\theta 2$ are equal to each other, and the angular displacement $\theta 3$ is 180°.

Figure 25:
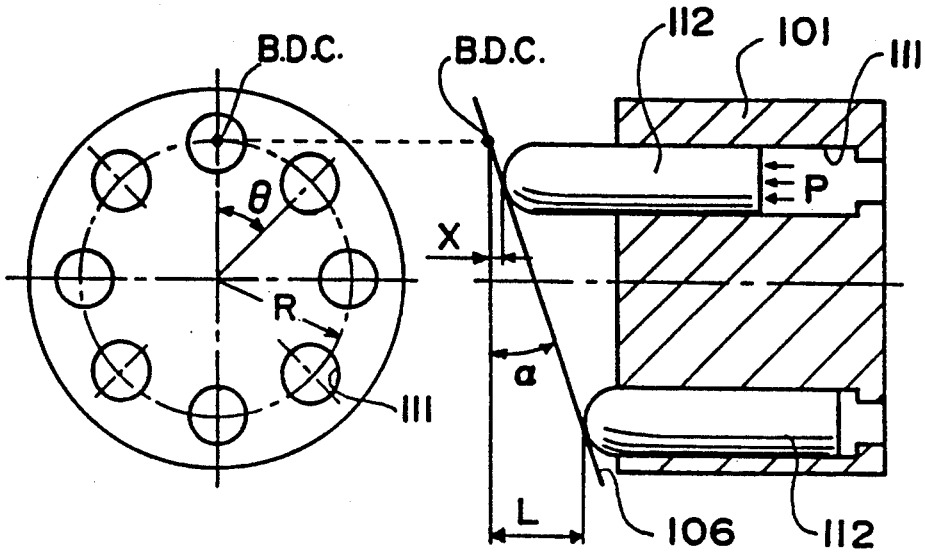
Fig.25 PRIOR ART
FIG. 25 is a schematic view of a swash-plate plunger-type hydraulic pump model.

FIG. 21 shows the relationship between the pulsating ratio $\epsilon$ of a discharged flow and the angular displacements $\theta 1$, $\theta 2$ in the hydraulic pump where the angular displacements $\theta 1$, $\theta 2$, $\theta 3$ are selected as described above and ten plungers 12 are employed. It can be seen from FIG. 25 that the pulsating ratio $\epsilon$ at the time the hydraulic pressure changes according to a square pattern ($\theta 1=\theta 2=0°$) is about 5%, whereas the pulsating ratio $\epsilon$ at the time the hydraulic pressure changes according to a trapezoidal pattern ($\theta 1=\theta 2=20°$) is about 7%, which is larger than when the hydraulic pressure changes according to a square pattern.

In this embodiment, as shown in FIG. 21, the pulsating ratio $\epsilon$ is minimum ($\epsilon=4\%$) at a point A where $\theta 1=\theta 2=44°$. Consequently, when the angular displacements $\theta 1$, $\theta 2$ are selected to be $\theta 1=\theta 2=44°$, the hydraulic pressure gradually varies, and the pulsating ratio $\epsilon$ is reduced.

Figure 22:
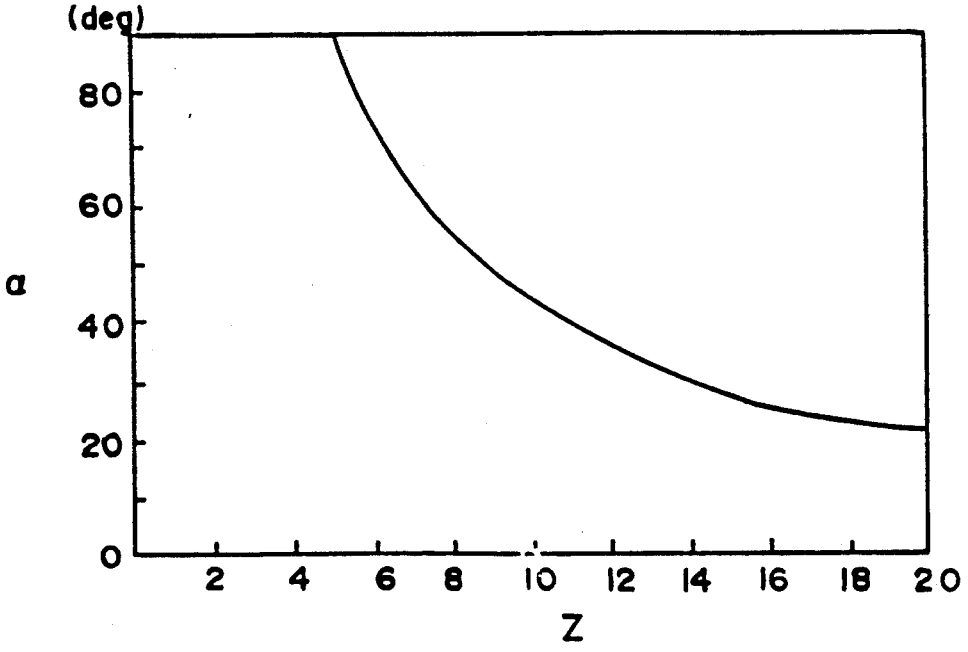
FIG. 22 is a graph showing the relationship between an angular displacement $\alpha$ and the number Z of plungers which make a pulsating ratio $\epsilon$ minimum in a swash-plate plunger-type hydraulic pump.
Figure 26:
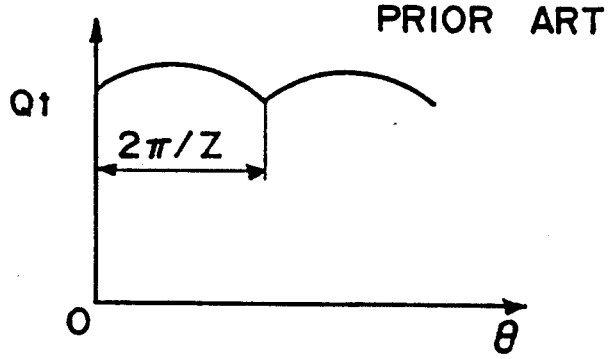
Fig.26 PRIOR ART
FIG. 26 is a graph showing the relationship between an instantaneous discharge rate Qt and the angular displacement of the cylinder block of the hydraulic pump shown in FIG. 25.
Figure 27A:
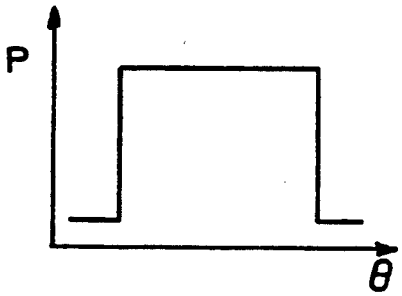
Fig.27(A) PRIOR ART
FIGS. 27(A) and 27(B) are graphs illustrating the manner in which the hydraulic pressure in a cylinder of a swash-plate plunger-type hydraulic pump varies.
Figure 27B:
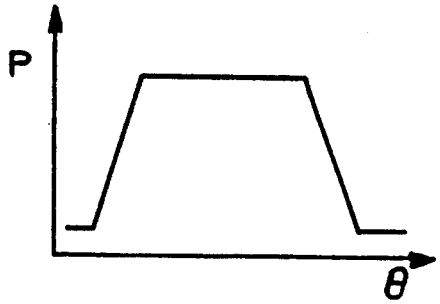
Fig.27(B) PRIOR ART

However, the value $\alpha$ of the angular displacements $\theta 1$, $\theta 2$ which makes the pulsating ratio $\epsilon$ minimum varies depending on the number Z of plungers used. The relationship between the value $\alpha$ and the number Z is shown in FIG. 22. The curve shown in FIG. 26 is expressed by the equation:

$$\alpha=469\times Z^{-1.0315}\text{ (degrees)} \quad (4).$$

Therefore, if the discharge and suction ports 14, 15 in a swash-plate plunger-type hydraulic device having an even number of plungers are defined such that both the angular displacements $\theta 1$, $\theta 2$ are equalized to the angle $\alpha$ according to the equation (4) and the angular displacement $\theta 3$ is substantially equal to 180°, then any change in the hydraulic pressure in the cylinder gradually varies and the pulsating ratio $\epsilon$ is lowered.

Figure 23:
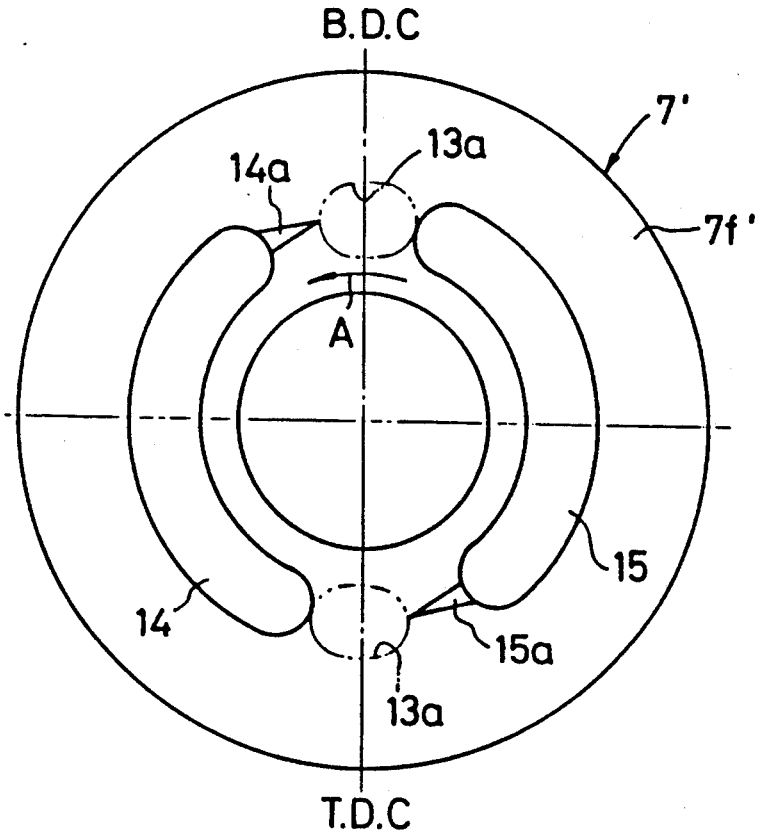
FIG. 23 is an elevational view of a different distribution valve plate.
Figure 24:
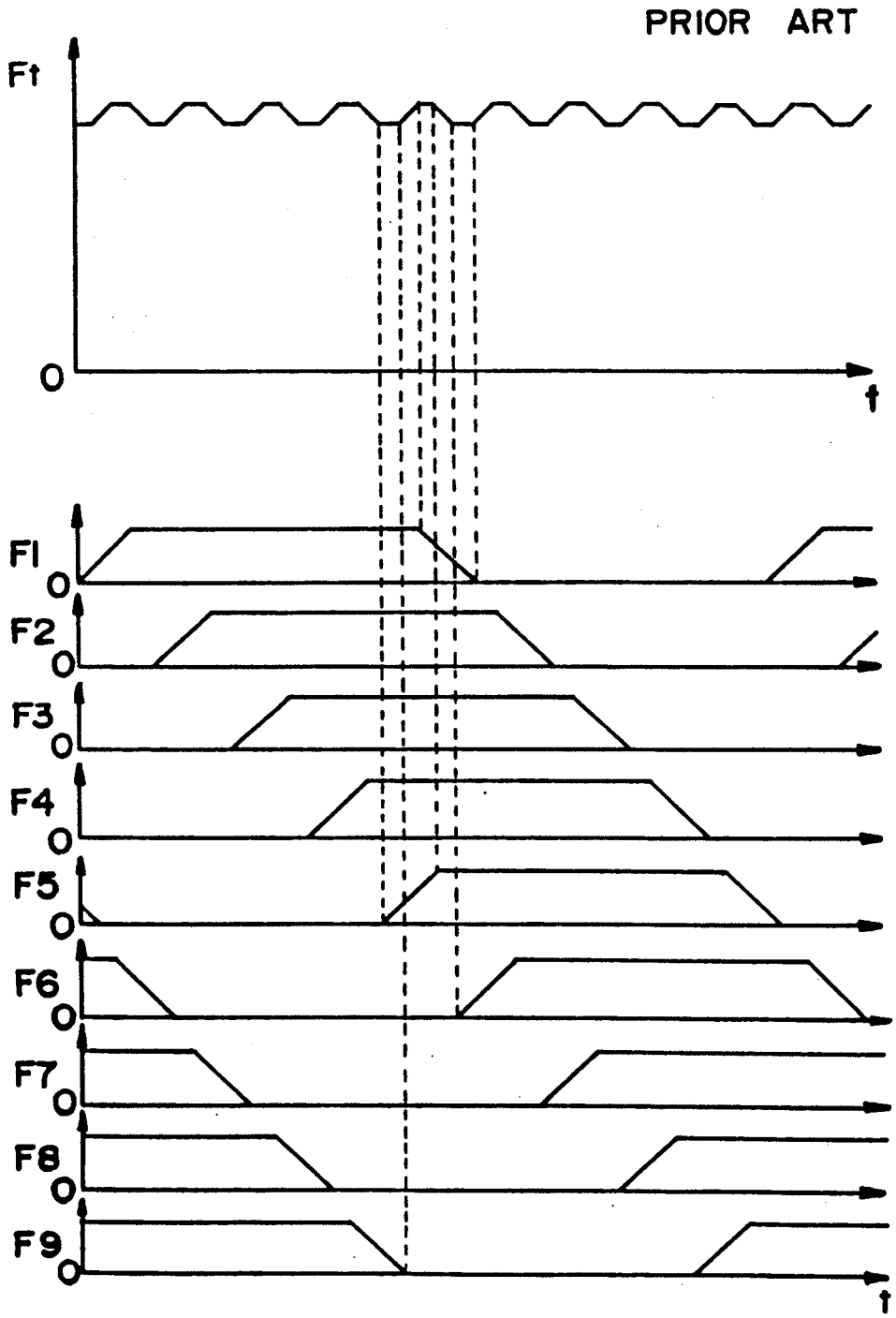
FIG. 24 is a graph showing how thrust loads acting on respective plungers and a total thrust load vary as the cylinder block rotates in a conventional swash-plate plunger-type hydraulic pump having an odd number of plungers.

In this embodiment, the angular displacements $\theta 1$, $\theta 2$, $\theta 3$ should be selected as described above. It may be difficult to cause the hydraulic pressure to vary gradually in the pressure-increasing interval of the angular displacement $\theta 1$ and the pressure-reducing interval of the angular displacement $\theta 2$ as shown in FIGS. 4 and 5. To eliminate such difficulty, as shown in FIG. 23, a distribution valve plate 7' may have V-shaped grooves 14*a*, 15*a* at ends of discharge and suction ports 14, 15 to achieve the gradual change of the hydraulic pressure as shown in FIGS. 23 and 24.

The V-shaped grooves 14*a*, 15*a* may be replaced with holes or valves to obtain the hydraulic pressure change as shown in FIG. 4.

The principles of the present invention are incorporated in a swash-plate plunger-type hydraulic pump in the above embodiment, but may be embodied in a swash-plate plunger-type hydraulic motor.

In the illustrated second embodiment, the swash-plate plunger-type hydraulic pump is of the variable displacement type wherein the swash plate is tiltable through different angles. However, the swash-plate plunger-type hydraulic pump may be of the fixed displacement type.

The above second embodiment has been described with respect to a swash-plate plunger-type hydraulic pump or motor only. However, a swash-plate plunger-type hydraulic pump and a swash-plate plunger-type hydraulic motor of the above arrangement may be combined into a hydraulically operated continuously variable transmission as shown in FIG. 15.

In the case where the hydraulically operated continuously variable transmission composed of the hydraulic pump P and the hydraulic motor M is used as the transmission of a motor vehicle, while the motor vehicle is running at high speed, the hydraulic motor M also rotates at high speed. At this time, the transmission may produce high-frequency noise due to an abrupt change in the hydraulic pressure in the cylinder bores of the motor and a large pulsation of the discharged flow. Such high-frequency noise can be prevented from being generated when an even number of motor plungers 72 are employed, the angular displacements $\theta 1$, $\theta 2$ are substantially equal to the angle according to the equation (4) above, and the angular displacement $\theta 3$ is 180°. Specifically, for example, ten motor plungers 72 may be employed, and the angular displacements $\theta 1$, $\theta 2$ may be selected to be $\theta 1=\theta 2=44°$.

If the angular displacements $\theta 1$, $\theta 2$ are increased, then the volumetric efficiencies of the hydraulic motor and pump are lowered. In the hydraulically operated continuously variable transmission shown in FIGS. 15 and 16, however, while the motor vehicle is running at high speed, since the swash plate holder 73 is tilted nearly at a minimum angle (where the speed reduction ratio $i=1$), the ratio of hydraulic power transmission is relatively small, and hence any reduction in the power transmitting efficiency of the transmission is relatively small. Therefore, the hydraulically operated continuously variable transmission incorporating the principles of the present invention can effectively prevent the generation of high-frequency noise without lowering the power transmitting efficiency.

The power transmitting efficiency will be reviewed in greater detail below.

The ratio of hydraulic power transmission (hydraulic pressure transmission ratio) in the hydraulically operated continuously variable transmission is expressed by:

$$\text{Hydraulic pressure transmission ratio} = 1-(1/i)$$

where i is the speed reduction ratio=(input rotational speed)/(output rotational speed).

The ratio of mechanical power transmission (mechanical transmission ratio) is given by:

$$\text{Mechanical power transmission ratio} = 1/i.$$

If ten plungers are employed, and the ports are defined so that $\theta 1=\theta 2=44°$, then the hydraulic pressure transmission is reduced by about 10%. Therefore, the overall power transmitting efficiency $\eta$ of the hydraulic pump itself as shown in FIG. 1 is 90%. The overall power transmitting efficiency $\eta$ of the hydraulically operated continuously variable transmission shown in FIG. 15 is:

$$\begin{aligned}\eta &= \{(\text{mechanical transmission ratio}) + \\ &(\text{hydraulic pressure transmission ratio}\times 0.9\}\times 100 \\ &= \{(1/i)+(1-1/i)\times 0.9\}\times 100.\end{aligned}$$

Therefore, when the speed reduction ratio is $i=1.5$, for example, the overall power transmitting efficiency is $\eta=96.7\%$. The hydraulically operated continuously variable transmission can be operated with a higher efficiency than the hydraulic pump itself. Stated otherwise, the hydraulic device according to the present invention is highly advantageous from the standpoint of efficiency if incorporated in hydraulically operated continuously variable transmissions.

Although certain preferred embodiments of the present invention have been shown and described in detail, it should be understood that various changes and modifications may be made therein without departing from the scope of the appended claims.

What is claimed is:

1. A swash-plate plunger-type hydraulic device comprising:

a rotatable shaft;

a cylinder block mounted on said rotatable shaft for rotation in unison therewith, said cylinder block having an even number of cylinder bores arranged in an annular array around said rotatable shaft and extending axially of said rotatable shaft, said cylinder bores opening at one axial end of said cylinder block;

an even number of plungers slidably fitted in said cylinder bores;

a swash plate disposed in confronting relation to said one axial end of said cylinder block, said plungers having ends slidably held against said sash plate;

a distribution valve plate slidably held against an opposite axial end of said cylinder block;

said cylinder block having an even number of circularly arranged connecting ports defined therein in communication with said cylinder bores, respectively, and opening at said opposite end;

said distribution valve plate having an inlet port defined therein in communication with the cylinder bores housing those plungers which are in an expansion stroke, through said connecting ports upon rotation of said cylinder block, and an outlet port defined therein in communication with the cylinder bores housing those plungers which are in a compression stroke, through said connecting ports upon rotation of said cylinder block;

said cylinder block being rotatable with said rotatable shaft through an angular displacement $\theta 1$ corresponding to an angular interval in which one, at a time, of said connecting ports is positioned between said inlet and outlet ports and a hydraulic pressure in said one of the connecting ports and the cylinder bore communicating therewith increases from a lower hydraulic pressure within one of said inlet and outlet ports to a higher hydraulic pressure within the other of said inlet and outlet ports, through an angular interval $\theta 2$ corresponding to an angular interval in which one, at a time, of said connecting ports is positioned between said inlet and outlet ports and a hydraulic pressure in said one of the connecting ports and the cylinder bore communicating therewith decreases from the higher hydraulic pressure within the other of said inlet and outlet ports to the lower hydraulic pressure within said one of said inlet and outlet ports, and through an angular interval $\theta 3$ corresponding to an angular interval from a position where the hydraulic pressure starts to increase to a position where the hydraulic pressure starts to decrease, said inlet and outlet ports being defined such that said angular displacements $\theta 1$, $\theta 2$, $\theta 3$, are expressed by:

$$\theta 1 = \theta 2 \text{ and } \theta 3 = 180°;$$

wherein said inlet and outlet ports are defined such that said angular displacements $\theta 1$ and $\theta 2$ are expressed by:

$$\theta 1 = \theta 2 = 360°/Z \times k$$

where

Z is the number of plungers, an even number; and $k = 1, 2, 3, \ldots$, k being an integer.

2. A swash-plate plunger-type hydraulic device according to claim 1, wherein said swash-plate plunger-type hydraulic device comprises a swash-plate plunger-type hydraulic pump.

3. A swash-plate plunger-type hydraulic device according to claim 1, wherein said swash-plate plunger-type hydraulic device comprises a swash-plate plunger-type hydraulic motor.

4. A swash-plate plunger-type hydraulic device according to claim 1, wherein said swash-plate plunger-type hydraulic device comprises a swash-plate plunger-type hydraulically operated transmission composed of a swash-plate plunger-type hydraulic pump and a swash-plate plunger-type hydraulic motor.

5. A swash-plate plunger-type hydraulic device according to claim 4, wherein said swash-plate plunger-type hydraulically operated transmission has a housing, an input member, and an output member, said input and output members being rotatably supported in said housing, said swash-plate plunger-type hydraulic pump being of the fixed displacement type and having a pump cylinder block coupled to said input shaft and a pump swash plate, said swash-plate plunger-type hydraulic motor being of the variable displacement type and having a motor cylinder block disposed coaxially with said pump cylinder block and a motor swash plate, said motor cylinder block being rotatably disposed around said pump cylinder block and coupled to said pump swash plate, said motor swash plate being angularly movably supported in said housing, said motor cylinder block being coupled to said output member.

6. A swash-plate plunger-type hydraulic device comprising:

a rotatable shaft;

a cylinder block mounted on said rotatable shaft for rotation in unison therewith, said cylinder block having an even number of cylinder bores arranged in an annular array around said rotatable shaft and extending axially of said rotatable shaft, said cylinder bores opening at one axial end of said cylinder block;

an even number of plungers slidably fitted in said cylinder bores;

a swash plate disposed in confronting relation to said one axial end of said cylinder block, said plungers having ends slidably held against said swash plate;

a distribution valve plate slidably held against an opposite axial end of said cylinder block;

said cylinder block having an even number of circularly arranged connecting ports defined therein in communication with said cylinder bores, respectively, and opening at said opposite axial end;

said distribution valve plate having an inlet port defined therein in communication with the cylinder bores housing those plungers which are in an expansion stroke, through said connecting ports upon rotation of said cylinder block, and an outlet port defined therein in communication with the cylinder bores housing those plungers which are in a compression stroke, through said connecting ports upon rotation of said cylinder block;

said cylinder block being rotatable with said rotatable shaft through an angular displacement $\theta 1$ corresponding to an angular interval in which one, at a time, of said connecting ports is positioned between said inlet and outlet ports and a hydraulic pressure in said one of the connecting ports and the cylinder bore communicating therewith increases from a lower hydraulic pressure within one of said inlet and outlet ports to a higher hydraulic pressure within the other of said inlet and outlet ports, through an angular interval $\theta 2$ corresponding to an angular interval in which one, at a time, of said connecting ports is positioned between said inlet and outlet ports and a hydraulic pressure in said one of the connecting ports and the cylinder bore communicating therewith decreases from the higher hydraulic pressure within the other of said inlet and outlet ports to the lower hydraulic pressure within said one of said inlet and outlet ports, and through an angular interval $\theta 3$ corresponding to an angular interval from a position where the hydraulic pressure starts to increase to a position where the hydraulic pressure starts to decrease, said inlet and outlet ports being defined such that said angular displacements $\theta 1$, $\theta 2$ are substantially equal to:

$$\alpha = 469 \times Z^{-1.0315} \text{ degrees}$$

where Z is the number of the plungers, an even number, and said angular displacement $\theta 3$ is equal to:

$$\theta 3 = 180°.$$

7. A swash-plate plunger-type hydraulic device, according to claim 6, wherein said swash-plate plunger-type hydraulic device comprises a swash-plate plunger-type hydraulic pump.

8. A swash-plate plunger-type hydraulic device according to claim 6, wherein said swash-plate plunger-type hydraulic device comprises a swash-plate plunger-type hydraulic motor.

9. A swash-plate plunger-type hydraulic device according to claim 6, wherein said swash-plate plunger-type hydraulic device comprises a swash-plate plunger-type hydraulically operated transmission composed of a swash-plate plunger-type hydraulic pump and a swash-plate plunger-type hydraulic motor.

10. A swash-plate plunger-type hydraulic device according to claim 9, wherein said swash-plate plunger-type hydraulically operated transmission has a housing, an input member, and an output member, said input and output members being rotatably supported in said housing, said swash-plate plunger-type hydraulic pump being of the fixed displacement type and having a pump cylinder block coupled to said input shaft and a pump swash plate, said swash-plate plunger-type hydraulic motor being of the variable displacement type and having a motor cylinder block disposed coaxially with said pump cylinder block and a motor swash plate, said motor cylinder block being rotatably disposed around said pump cylinder block and coupled to said pump swash plate, said motor swash plate being angularly movably supported in said housing, said motor cylinder block being coupled to said output member.

* * * * *